US009605869B2

(12) United States Patent
Bailey

(10) Patent No.: US 9,605,869 B2
(45) **Date of Patent: *Mar. 28, 2017**

(54) RADON EXHAUST SYSTEM WITH INTERNIAL GASEOUS FLUID FAN WITHIN DIAGNOSTIC BYPASS FILTER FAN APPARATUS

(71) Applicant: Wayne Edward Bailey, Fredericksburg, VA (US)

(72) Inventor: Wayne Edward Bailey, Fredericksburg, VA (US)

(73) Assignee: Wayne Edward Bailey, Fredericksburg, VA (US)

( * ) Notice: Subject to any disclaimer, the term of this patent is extended or adjusted under 35 U.S.C. 154(b) by 332 days.

This patent is subject to a terminal disclaimer.

(21) Appl. No.: 13/999,836

(22) Filed: Mar. 27, 2014

(65) Prior Publication Data

US 2015/0276248 A1 Oct. 1, 2015

(51) Int. Cl.

| | |
|---|---|
| ***F24F 13/28*** | (2006.01) |
| ***F24F 13/22*** | (2006.01) |
| ***F24F 3/16*** | (2006.01) |
| ***F24F 7/06*** | (2006.01) |
| *F24F 7/00* | (2006.01) |

(52) U.S. Cl.

CPC ..... *F24F 13/28* (2013.01); *F24F 3/16* (2013.01); *F24F 7/065* (2013.01); *F24F 13/22* (2013.01); *F24F 2003/1696* (2013.01); *F24F 2007/001* (2013.01); *F24F 2221/52* (2013.01)

(58) Field of Classification Search

CPC .. F24F 13/22; F24F 13/28; F24F 7/065; F24F 3/16; F24F 2003/1696; F24F 2007/001; F24F 2221/52

USPC ..... 454/356

See application file for complete search history.

(56) References Cited

U.S. PATENT DOCUMENTS

| | | | | | |
|---|---|---|---|---|---|
| D309,181 | S | * | 7/1990 | Simon | D23/371 |
| 4,995,309 | A | * | 2/1991 | Weaver | E02D 31/008 285/64 |
| 5,083,500 | A | * | 1/1992 | Francis | B08B 9/0495 454/341 |
| D437,042 | S | * | 1/2001 | Kapturowski | D23/370 |
| 6,524,182 | B2 | * | 2/2003 | Kilburn | F24F 7/00 454/341 |

(Continued)

*Primary Examiner* — Joshua Kennedy

(57) ABSTRACT

A radon exhaust system comprising a cylindrical shaped vent housing, diagnostic filter fan housing, inline fan with redirecting vanes, ice filter, observation windows, access opening and closure cap, air flow indicators, water gutter, drain spout and an enlarged elliptical bulge area for additional air passage through the fan housing. The inline fan, located within the elliptical bulge, pumps radon laced air into redirecting vanes, which directs same air through exhaust side and out through expanded exhaust openings of the vent housing. Additionally, redirecting vanes protect the fan from falling ice which may be formed on the ice filter located above the fan. Water is prevented from entering the fan by a water gutter and drain. Observation windows allow visual interior monitoring without entering the fan housing. An access opening with closure cap allows interior maintenance, testing and off venting. These embodiments combine to protect radon systems from damage.

8 Claims, 10 Drawing Sheets

(56) References Cited

U.S. PATENT DOCUMENTS

| | | | | |
|---|---|---|---|---|
| 6,527,005 | B2 * | 3/2003 | Weaver | E02D 31/008 137/312 |
| 7,677,964 | B1 * | 3/2010 | Bucher | F24F 7/025 454/356 |
| 8,496,515 | B2 * | 7/2013 | Bailey | F04D 29/701 137/312 |
| 9,062,454 | B1 * | 6/2015 | Borgman | F24F 7/06 |
| 9,140,461 | B2 * | 9/2015 | Bailey | F24F 3/16 |
| 2013/0295837 | A1 | 11/2013 | Bailey | |

* cited by examiner

RADON EXHAUST SYSTEM WITH INTERNIAL GASEOUS FLUID FAN WITHIN DIAGNOSTIC BYPASS FILTER FAN APPARATUS

CROSS-REFERENCE TO RELATED APPLICATIONS

The present application claims priority from U.S. provisional patent application Ser. No. 61/854,469, filed Apr. 25, 2013, by Wayne Edward Bailey, incorporated by reference herein and for which benefit of the priority date is hereby claimed.

BACKGROUND

Radon is a cancer causing radioactive gas fluid that has been found in homes all over the United States. Radon typically moves up through the ground to the air above and into a building through cracks and other holes in the floor. You cannot see, smell or taste radon.

Sub-slab depressurization is the most common radon mitigation technique which requires several installation steps.

The radon mitigation system is a continuous piping system beginning under a house concrete basement slab, and terminating outside and above the house.

Traditionally an inline radon fan is installed in the piping system to draw the radon laced air from under the basement concrete slab to the outside and above the house.

The radon-laced air is pulled from under the basement concrete floor slab by a radon fan and pumped up the exhaust pipe and dispersed harmlessly into the atmosphere.

The radon-laced air is at "earth temperature" of about 55 degrees Fahrenheit with a high percent of moisture content.

This produces air with high humidity content up to one (1) gallon per day being vented through the radon mitigation system.

Radon mitigation protocol requires that radon mitigation systems be operational continuously. The radon mitigation system continues to operate during warm periods of the year and winter freezing periods of the year. During warmer periods, the humid air will turn to condensate and fall back into the radon fan in the form of water which causes damage to the radon fan.

Many current radon system water bypass devices restrict air flow, causing the radon fan motor to over work and heat up, reducing the fan's efficiency and life.

Currently, radon systems do not provide radon fans with built-in protection from falling ice, observation windows, access opening for testing and maintenance, built-in air flow indicators, water damage protection, an enlarged bulge area to prevent air flow restrictions, as one housing unit.

Freezing temperatures in the atmosphere during the winter causes condensate to turn to ice in the radon mitigation system exhaust pipe. As more moist air is blown into the exhaust pipe, ice continues to build and restrict air movement in the upper portion of the exhaust pipe. As the exhaust pipe becomes blocked with ice, the radon mitigation system becomes inoperative.

During warm-up periods the ice breaks apart from the exhaust pipe and falls into the radon fan, causing fan damage. It is common for winter nights to freeze and winter days to thaw, resulting in many freeze-thaw cycles during a winter season. A problem with the metal screen cap is that the screen itself displaces 20% of area, thus reducing air passage to 80% in relationship to the size of the exhaust pipe.

Adding to the ice build-up problem is the metal wire screen-cap, which freezes when installed at the top end of the exhaust pipe where the humid air is exposed to the freezing temperature of the atmosphere and collects on the screen causing complete air flow blockage.

The metal wire grid screen-cap, installed at the top of the radon system exhaust pipe is exposed to quick freezing during below freezing temperatures. The metal grid screen compounds the ice build-up problem as it catches moisture from the moist air passing through the screen, increasing ice build-up. The ice will partially melt, and pieces will break off and drop down into the radon fan, causing fan damage or complete failure.

The damage to the radon fan from falling ice is a health and economic problem because when the radon system is not operating, radon is not being removed from the house, rendering the occupants at risk, additionally, the radon fan will over heat and stop operating.

Another problem with the current metal wire grid screen, installed on the top side of a radon system is to allowing rain to enter, which drains down into the radon fan causing damage. Another problem with the horizontal placement of a metal wire grid screen during freezing periods, is allowing sleet and snow to build-up and block air flow, rendering the radon system inoperable and putting strain on the radon fan.

Currently, radon systems don't fully address ice and water damage problems to radon fans.

Therefore, for the health and welfare of building occupants it would be desirable to provide an apparatus to correct these issues within one unit.

BACKGROUND—PRIOR ART

Radon mitigation systems are expected to perform under unique and high demanding conditions. Air pumped from under a building's sub-slab is both at earth temperature (55 F.) and moist, containing a very high degree of water vapor. Because of the high degree of water vapor within the air and the vast difference of earth temperature air (55 F) at the suction point and temperature below freezing at the exit point, ice formation within the system is a common occurrence.

Currently metal wire grid screens are attached horizontally to the top of exhaust pipes and freeze over much faster, collect sleet and snow to create blockage in the exit area of the mitigation system.

Current radon fans, installed as a stand-alone device within a radon mitigation system has no built-in protection from damage due to ice, water or foreign objects that may enter the fan or block the piping system.

Currently a radon fan can be protected from returning water with a condensate bypass apparatus, U.S. Pat. No. 6,527,005 issued to Weaver, Mar. 4, 2003. However U.S. Pat. No. 6,527,005 does not provide a means to eliminate the birds and animals screen at the exit point of the exhaust pipe which contributes to undesirable ice build-up. U.S. Pat. No. 6,527,005 does not provide a means to stop ice, birds and animals, debris or rain water from falling into the radon fan. U.S. Pat. No. 6,527,005 does not provide a means for an access port to allow cleaning or inspections.

Utility patent application Ser. No. 13/068,620 by Bailey (self) May 16, 2011.

Application Ser. No. 13/068,620, does not address the issue of installing an internal gaseous fluid fan within the diagnostic bypass filter fan housing, providing a more efficient radon mitigation system.

Application Ser. No. 13/068,620, does not address the issue of the screen, gutter and trough creating air resistance that reduces the amount of air passing through the separator housing.

Application Ser. No. 13/068,620, does not include observation windows within the closure cap.

Application Ser. No. 13/068,620 does not include observation windows on the sides of the separator housing.

Application Ser. No. 13/068,620 does not include non-mechanical air flow indicators within the separator housing.

Application Ser. No. 13/068,620 does not include mechanical air flow indicators within the separator housing.

Application Ser. No. 13/068,620 does not include an enlarged air passage bulge area within the diagnostic bypass filter fan housing to address the problem of air resistance.

Application Ser. No. 13/068,620 does not prevent rain water from entering the radon mitigation system.

Application Ser. No. 13/068,620 does not address the issue of moist air originating from the damp sub-soil coming in contact and freezing on the metal grid surface of the birds and animals screen.

Application Ser. No. 13/068,620 does not include a screen support and gutter floor combined as one and additionally combined as one with the housing wall, making the gutter floor, screen support and housing to be one unit.

Utility patent application Ser. No. 13/506,583 by Bailey (self) May 16, 2012, currently under review by the USPTO at this date application Ser. No. 13/506,583does not address the issue of installing an internal gaseous fluid fan within the diagnostic bypass filter fan housing, providing a more efficient radon mitigation system.

Currently a separate radon fan unit is required to construct a conventional radon mitigation system, requiring additional labor, additional adapters/connectors and additional unit cost to construct a complete radon mitigation system. Additionally current radon fans do not provide embodiments to protect itself from damage caused by ice and water combined. Current radon fans also do not provide an access opening for testing and maintenance, nor do they contain windows to observe operational conditions.

ADVANTAGES

By having the radon fan and directional vanes placed within the diagnostic bypass filter fan housing in close proximity to the ice filter, the fan has a higher degree of protection from damage.

Current radon fans have no means of ice and water damage protection, observation windows for monitoring internal conditions or an access opening for internal maintenance and testing.

The ice filter, redirecting vanes and fan bracket, provide three (3) separate ice blocking embodiments to protect the inline fan.

First (1), the ice filter, which is located above and in close proximity of the inline fan, blocks falling ice from entering the fan.

Second (2), the fan bracket, which is located above the radon fan blocks any dropping ice that forms on the ice filter during extreme freezing weather.

Third (3), the redirecting vanes prevents dropping ice that forms on the ice filter from having a direct route into the radon fan.

Current radon fans have no form of damage protection and are sold with instructions, "do not attempt any disassembly, repairs or alterations to the fan". This suggests that the radon fan housing is not to be opened, altered or any repairs performed, therefore if it becomes necessary to dislodge debris, perform maintenance or testing, costly fan replacement is the only solution to restarting the radon mitigation system.

Another advantage of having the radon fan, ice filter, access opening, observation windows, water gutter and spout designed as one complete housing unit is the uniformity and consistency of design, as compared to adding on mismatching parts resulting in patchwork assembly and inconsistent standards of quality.

Exit openings, located on the vertical side of the vent housing, with up to 700% more exit area than the attached three (3) inch diameter exhaust pipe extends open time during freezing weather, thus reducing air flow restrictions caused by sleet, snow and freezing rain.

Additionally, the vent housing, manufactured with plastic formulas, does not conduct ice as fast as conventional metal wire screens.

The unique challenges of pumping earth temperature radon laced air with a high degree of vapor content upward into a below freezing atmosphere requires the improved fan protection embodiments of this invention for constant and efficient system operation.

The unique challenges of radon mitigation, can best be met with the unique and non obvious embodiments of this invention.

SUMMARY

The present embodiment comprises a diagnostic bypass filter fan housing with a self contained internal gaseous fluid fan and a vent housing that prevents debris, birds and animals, ice and rain water from entering a gaseous fluid mitigation system.

The present embodiment further compensates air flow restrictions with an additional air flow bulge area within the diagnostic bypass filter fan housing, thus reducing fan stress and allowing the fan's air production to pass through the housing and vent housing with no added resistance. By preventing additional air flow resistance to the internal gaseous fluid fan, less electricity is consumed and the radon fan is not exposed to additional load stress.

Radon fans have a longer life and operate more efficiently if ice, debris and water are not ingested within the fan.

The present embodiments, further comprises a means to monitor and observe conditions within the diagnostic bypass filter fan housing to further extend the useful life of the gaseous fluid fan. The present embodiment further locates the gaseous fluid fan within the diagnostic bypass filter fan housing, within close proximity to additional embodiments resulting in a more efficient radon mitigation system.

BRIEF DESCRIPTION OF DRAWINGS—FIGURES

DRAWINGS—LIST OF REFERENCE NUMERALS

200, Gaseous fluid (Radon) mitigation system.
10, Diagnostic bypass filter fan housing.
11, Rear Observation Window.
11*a*, Closure Cap
11*b*, Access Opening
12, Left and Right Side Observation Windows.
13, Front Observation Window.
15, Ice Filter
16*a* Solid Base
16*b*, Uniform clearance gap
16*c*, Plurality of spaced air flow redirecting vanes
17, Fan bracket
17*a* Connection bolts
18 Inline centrifugal fan
18*a* Fan power cord
20, Exhaust side, Elbow.
21, Exhaust side, Pipe.
22, Exhaust side, Pipe Support Bracket.
23, Vent Housing
24, Flexible Exhaust Side, Coupling.
25, Unimproved Gaseous Fluid (Radon) Exhaust Fan.
26, Flexible Suction Side, Coupling.
27, Suction side, Elbow.
28, Suction side, Pipe.
32, Water Drain Spout.
34, Water Gutter.
41, Circular Suction Port
43, Circular Exhaust Port.
70, Unimproved Metal Bird and Animal Screen.
"B", Elliptical Bulge Area
"W", Water.
"R", Non-Mechanical Air Flow Indicator, ribbon.
"M" Mechanical Air Flow Indicator.
"S" Sub-Soil
"F" Floor Slab

DETAILED DESCRIPTION

Figure 1:
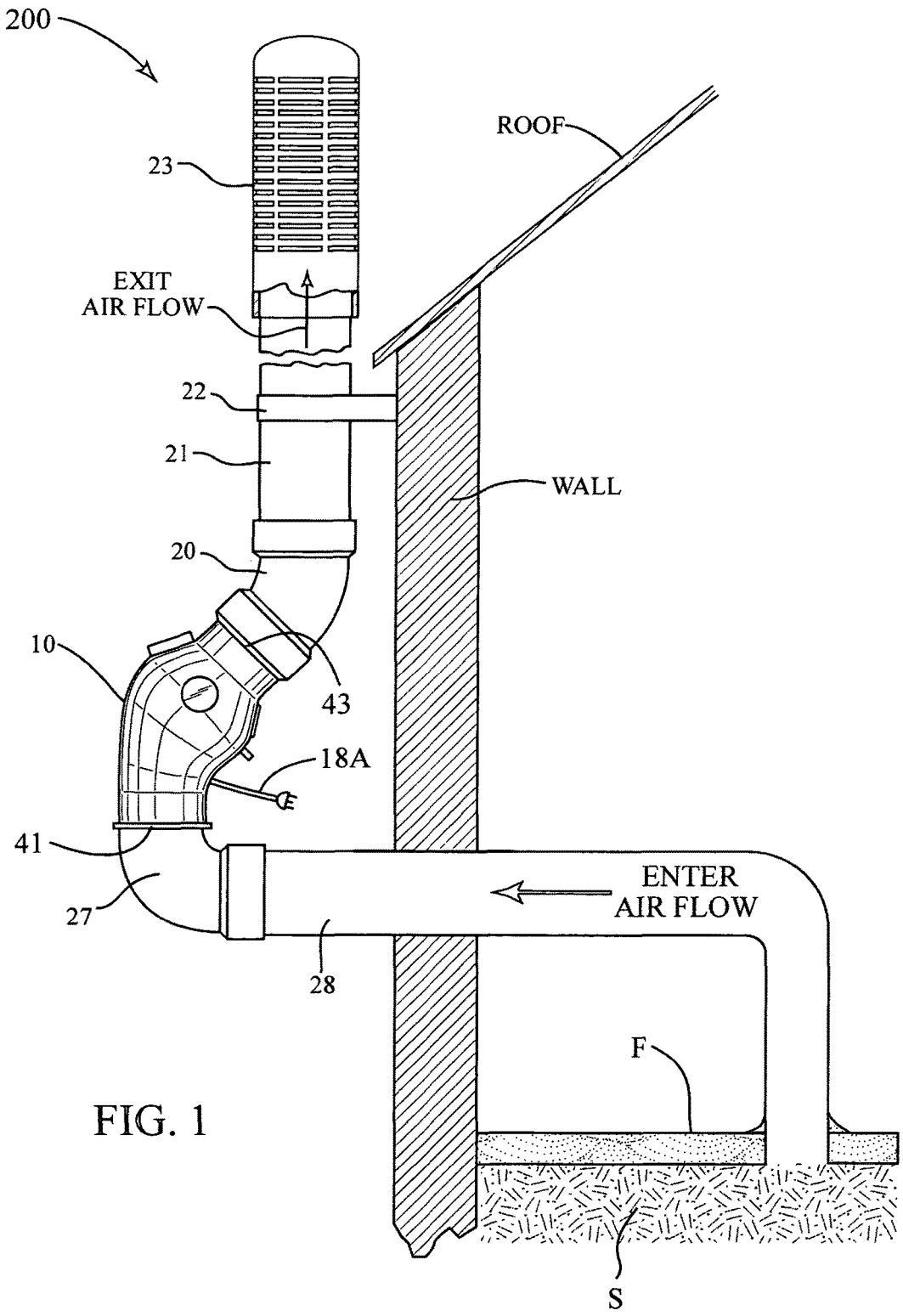
FIG. 1 shows a side view of a gaseous fluid (radon) mitigation system, including a diagnostic bypass filter fan housing and a vent housing.

FIG. 1 shows side view of a gaseous fluid (radon) mitigation system 200, with a hollow continuous air movement piping system originating from sub-soil "S" below a building concrete floor slab "F" to terminate above a roof edge of a building.

A diagnostic bypass filter fan housing 10, of said improved gaseous fluid (radon) mitigation system 200 draws warm, moist radon laced air from under said building concrete floor slab "F" and pumps same warm, moist radon laced air through said diagnostic bypass filter fan housing 10, to be expelled through a vent housing 23, into the atmosphere.

Embodiments shown within said diagnostic bypass filter fan housing 10, including a circular suction port 41, a circular exhaust port 43 and a fan power cord 18A.

Components shown below said diagnostic bypass filter fan housing 10, is suction side, pipe 28, and suction side, elbow 27, which comprises the suction side of said gaseous fluid (radon) mitigation system 200.

Components shown above said diagnostic bypass filter fan housing 10, is exhaust side elbow 20, exhaust side, pipe 21, said vent housing 23, and exhaust side, pipe 21, being attached to building wall by an exhaust side, pipe support bracket 22, which comprises the exhaust side of said gaseous fluid (radon) mitigation system 200.

Said vent housing 23 is a hollow cylindrical shaped embodiment which receives radon laced air from said exhaust side, pipe 21, and expels same radon laced air into the atmosphere.

Said vent housing 23, comprises a first open end to receive radon laced air pumped by an inline centrifugal fan 18, and a hollow cylindrical shaped interior with multiple horizontal elongated exhaust openings to expel same radon laced air into the atmosphere.

The multiple exhaust openings on the vertical side of said vent housing 23, are positioned, sized and shaped to allow maximum unrestricted air to exit said vent housing 23.

Said vent housing 23, is sealed on the horizontal top to force same air to exit through the vertical side exhaust openings.

The larger air flow capacity of the air exhaust openings exceeds the capacity of air entering said vent housing 23, by up to 700%, so as to compensate for air blockage resulting from ice build-up.

Figure 2:
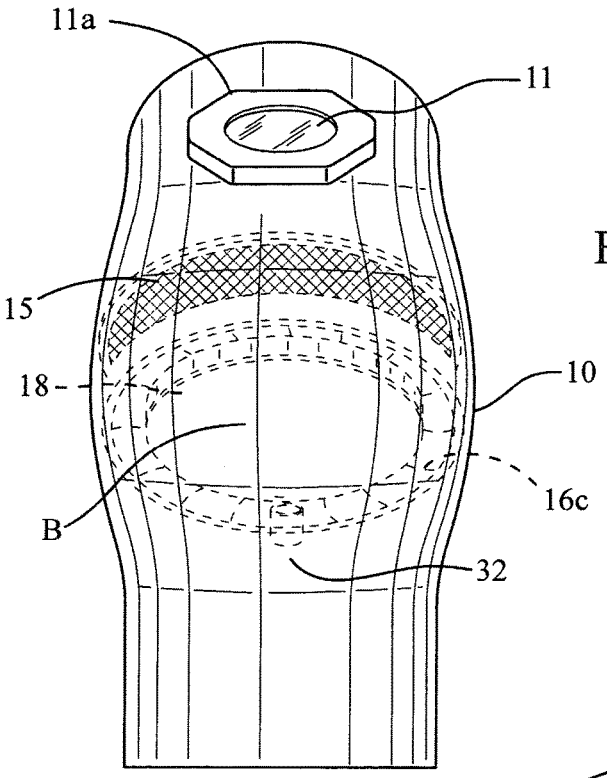
FIG. 2 shows a rear view of a diagnostic bypass filter fan housing.

FIG. 2 shows rear view of said diagnostic bypass filter fan housing 10, with a rear observation window 11, within a closure cap 11*a*. Said rear observation window 11, located within said closure cap 11*a*, located on the rear side of said diagnostic bypass filter fan housing 10, is an elliptical bulge area "B" with a hidden view of a water drain spout 32, a plurality of spaced air flow redirecting vanes 16*c*, and an inline centrifugal fan 18, which are positioned directly beneath an ice filter 15. Said ice filter 15, which is located above said inline centrifugal fan 18, is located within said elliptical bulge area "B", which is located within said diagnostic bypass filter fan housing 10.

Figure 3:
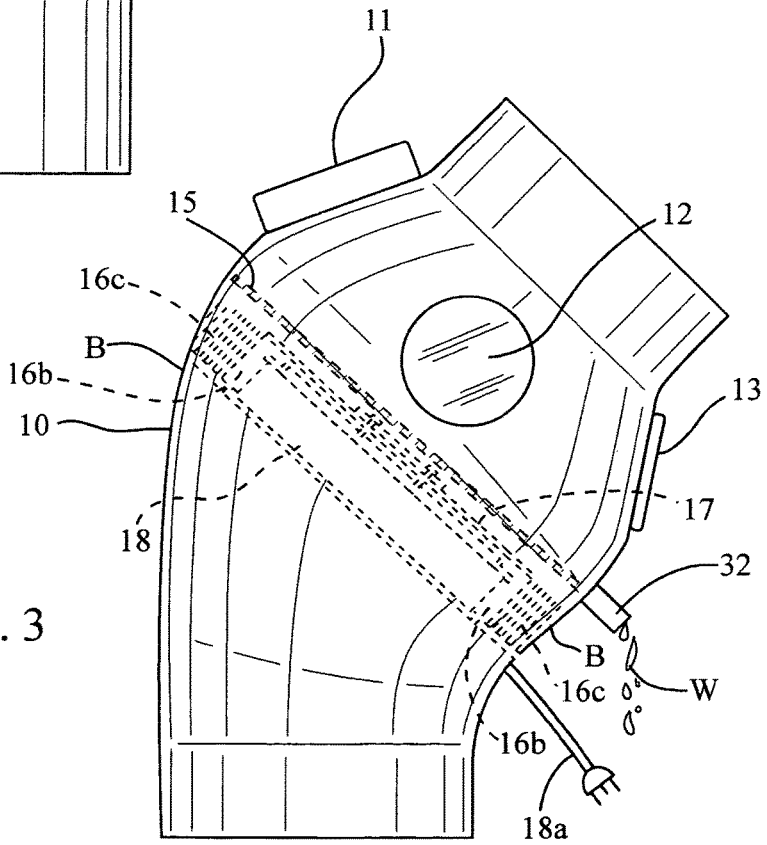
FIG. 3 shows a side view of a diagnostic bypass filter fan housing.

FIG. 3 shows the side view of said diagnostic bypass filter fan housing 10, with said rear observation window 11, left and a right side observation windows 12, front observation window 13. Within said diagnostic bypass filter fan housing 10, is said elliptical bulge area "B" with a hidden view of said ice filter 15, located above said plurality of spaced air flow directing vanes 16*c*.

Said plurality of spaced air flow redirecting vanes 16*c*, are molded into the inner wall of said diagnostic bypass filter fan housing 10.

Said inline centrifugal fan 18, and said fan power cord 18A extends through said diagnostic bypass filter fan housing 10.

Said rear observation window 11, located on the rear side and said left and right side observation windows 12, located on the left and right sides, and said front observation window 13, located on the front side of said diagnostic bypass filter fan housing 10.

Said observation windows 12 and 13 are molded to said diagnostic bypass filter fan housing 10.

Said inline centrifugal fan 18, located below said ice filter 15, is centrally positioned within said elliptical bulge area "B", and coaxial to said plurality of spaced air flow redirecting vanes 16*c*. The outer edges of said plurality of spaced air flow directing vanes 16*c*, are molded to the inner wall of said diagnostic bypass filter fan housing 10.

Said inline centrifugal fan 18, is even and coaxial to said plurality of spaced air flow redirecting vanes 16*c*, but not touching.

A circular center fan bracket 17, is molded into the inner upper corners of said plurality of spaced air flow redirecting vanes 16*c*. Said fan bracket 17, is orientated to hold said inline centrifugal fan 18. Said inline centrifugal fan 18, is positioned below and connected to said fan bracket 17 and is even with said plurality of spaced air flow redirecting vanes 16*c*.

Within said diagnostic bypass filter fan housing 10, said fan power cord 18*a*, is connected to and is an extension of said inline centrifugal fan 18.

Figure 4:
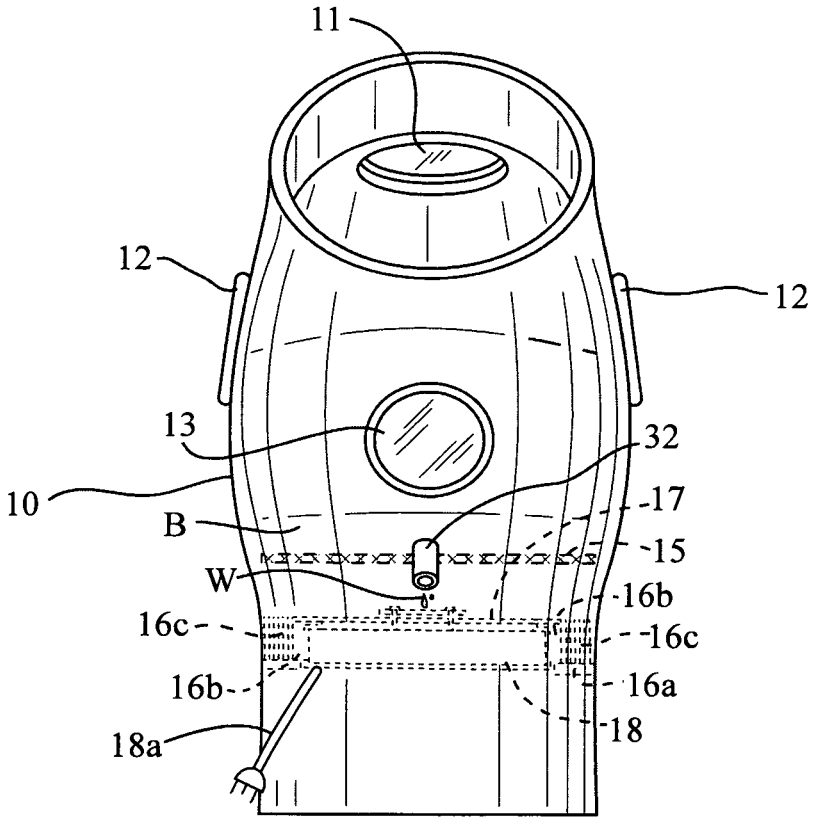
FIG. 4 shows a front view of diagnostic bypass filter fan housing.

FIG. 4 shows front view of said diagnostic bypass filter fan housing 10, with said rear observation window 11, said left and right side observation windows 12, said front observation window 13, and said water drain spout 32, molded to said diagnostic bypass filter fan housing 10.

Within said elliptical bulge area "B", is said plurality of spaced air flow redirecting vanes 16*c*, and a uniform clearance gap 16*b*, separating said inline centrifugal fan 18.

Said uniform clearance gap 16*b*, is positioned between the outer perimeter of said inline centrifugal fan 18, and the inner edges of said plurality of spaced air flow redirecting vanes 16*c*, to avoid contact between outer perimeter of said inline centrifugal fan 18, and inner edges of said plurality of spaced air flow redirecting vanes 16*c*.

The outer perimeter of said fan bracket 17, is molded to the inner upper corners of said plurality of spaced air flow redirecting vanes 16*c*. The outer edges of said plurality of spaced air flow redirecting vanes 16*c*, are molded to the inner wall of said diagnostic bypass filter fan housing 10. The outermost perimeter of said solid base 16*a*, is molded to the inner wall of said diagnostic bypass filter fan housing 10, and bottom edges of said plurality of spaced air flow redirecting vanes 16*c*, are molded into upper side of said solid base 16*a*.

Said inline centrifugal fan 18, is attached to said fan bracket 17, The outer edges of said plurality of spaced air flow directing vanes 16*c*, are molded to the inner wall of said diagnostic bypass filter fan housing 10, and are molded to said solid base 16*a*.

The inner edges of said plurality of spaced air flow redirecting vanes 16*c*, are radially extended inward toward the center of said elliptical bulge area "B", ending close to, but not touching said inline centrifugal fan 18, resulting in said uniform clearance gap 16*b*. The inner upper corners of said plurality of spaced air flow redirecting vanes 16*c*, are molded to the outer perimeter of said fan bracket 17.

Said inline centrifugal fan 18, is coaxial to said plurality of spaced air flow redirecting vanes 16*c*, but not touching, therefore resulting in said uniform clearance gap 16*b*, between said inline centrifugal fan 18, and said plurality of spaced air flow redirecting vanes 16*c*.

The upper side of said inline centrifugal fan 18, is connected to the bottom side of said fan bracket 17, with connection bolts 17*a*, therefore positioning said inline centrifugal fan 18, even and coaxial with said plurality of spaced air flow redirecting vanes 16*c*.

Figure 5:
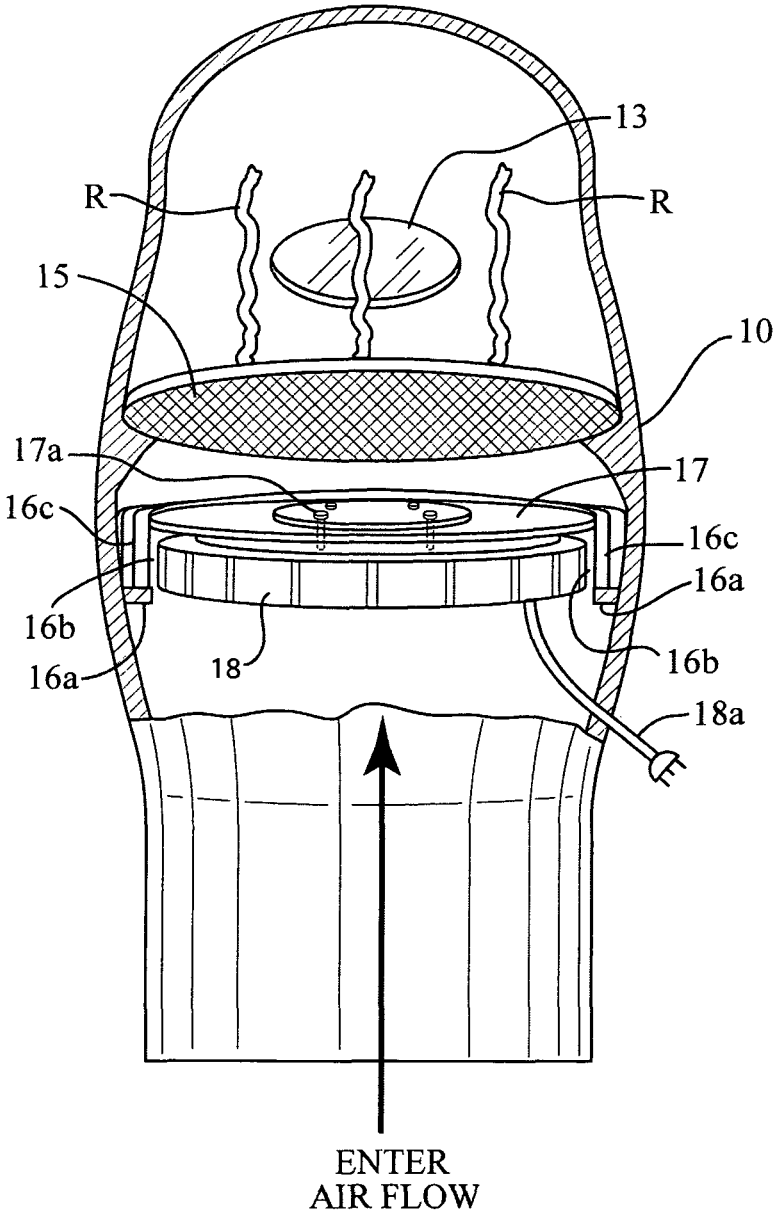
FIG. 5 shows a rear cut-away view of a diagnostic bypass filter fan housing.

FIG. 5 shows a rear cross sectional view of said diagnostic bypass filter fan housing 10. The inner edges of said plurality of spaced air flow redirecting vanes 16*c*, and the outer edge of said inline centrifugal fan 18, are separated by said uniform clearance gap 16*b*.

The inner upper corners of said plurality of spaced air flow redirecting vanes 16*c*, are molded to the outer perimeter of said fan bracket 17.

The top side of said inline centrifugal fan 18 is connected to the bottom side of said fan bracket 17, by connection bolts 17*a*. Said inline centrifugal fan 18 is coaxial and even to said plurality of spaced air flow redirecting vanes 16*c*.

Said fan bracket 17, is molded at its outer perimeter to the inner upper corners of said plurality of spaced air flow redirecting vanes 16*c*. The outer edges of said plurality of spaced air flow redirecting vanes 16*c*, are molded to the inner wall of said diagnostic bypass filter fan housing 10.

Said inline centrifugal fan 18, is connected to said fan bracket 17, being secured by said connection bolts 17*a*. Said fan bracket 17, is positioned above said inline centrifugal fan 18.

Said fan bracket 17, is molded to the inner upper corners of said plurality of spaced air flow directing vanes 16*c*.

Said inline centrifugal fan 18, is separated from said plurality of spaced air flow redirecting vanes 16*c*, by said uniform clearance gap 16*b*.

Said ice filter 15, is positioned directly above said fan bracket 17, and said polarity of spaced air flow redirecting vanes 16*c*. Said inline centrifugal fan 18, is connected below and to said fan bracket 17, by said connection bolts 17*a*.

Said fan power cord 18*a*, of said inline centrifugal fan 18, extends through said diagnostic bypass filter fan housing 10. A non-mechanical air flow indicator "R"; which is a flexible ribbon like length of material, is connected to, and extends above said ice filter 15, and is upwardly activated by passing air velocity which is pumped by said inline centrifugal fan 18. Said front observation window 13, is positioned on the front side of said diagnostic bypass filter fan housing 10.

Figure 6:
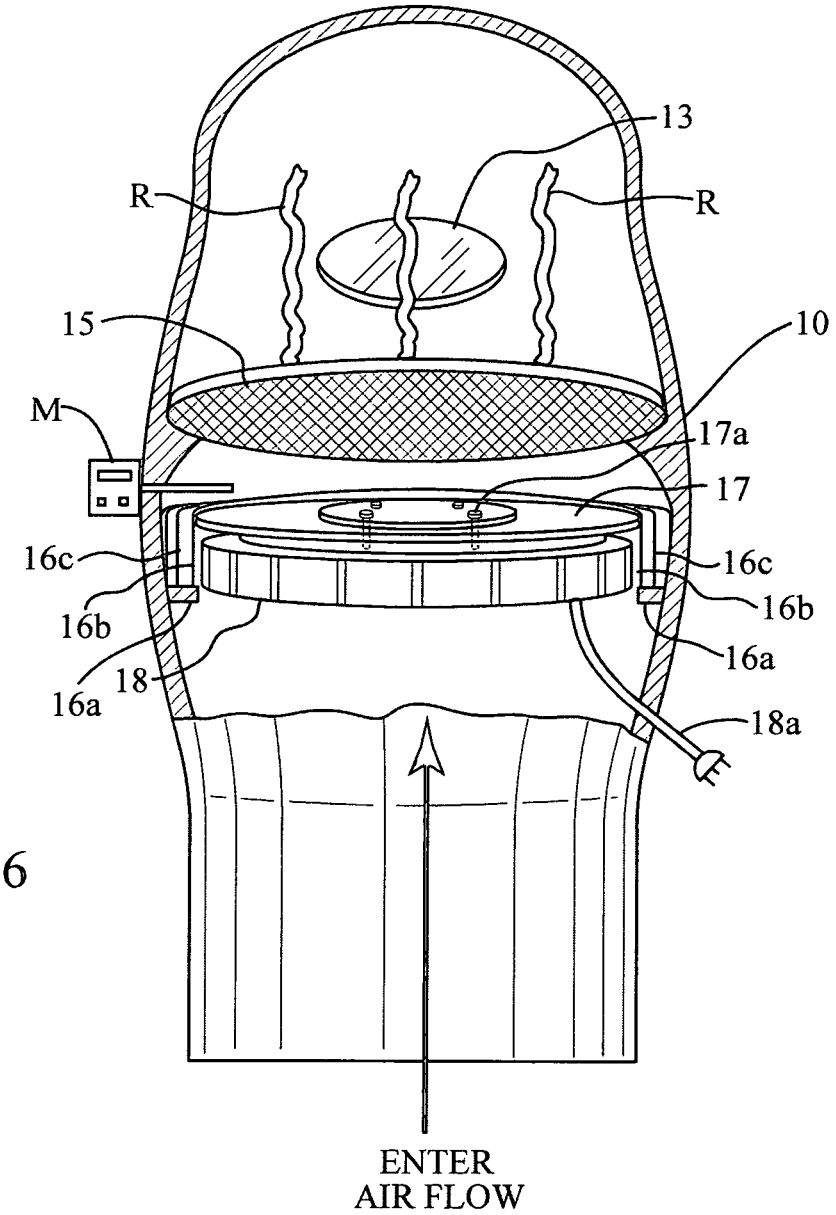
FIG. 6 shows a rear cut-away view of diagnostic bypass filter fan housing.

FIG. 6 shows a rear cross sectional view of said diagnostic bypass filter fan housing 10, with said plurality of spaced air flow redirecting vanes 16*c*, molded to the inner wall of said diagnostic bypass filter fan housing 10. Said fan bracket 17, is molded to inner upper corners of said plurality of spaced air flow redirecting vanes 16. Said polarity of spaced air flow redirecting vanes 16*c*, are molded into the upper surface of said solid base 16*a*, and the outer edge of said solid base 16*a*, is molded to the inner wall of said diagnostic bypass filter fan housing 10. Said inline centrifugal fan 18, is attached to the bottom side of said fan bracket 17, with connection bolts 17*a*. Said inline centrifugal fan 18, is coaxial to the plurality of spaced air flow redirecting vanes 16*c*. Said uniform clearance gap 16*b*, separates the outer perimeter of said inline centrifugal fan 18, from the inner edges of said plurality of spaced air flow redirecting vanes 16*c*. Said solid base 16*a*, said plurality of spaced air flow redirecting vanes 16*c*, said inline centrifugal fan 18, and said fan bracket 17, are located below said ice filter 15, within said elliptical bulge area "B".

Said fan power cord 18*a*, is an extension of said inline centrifugal fan 18, which extends out through said diagnostic bypass filter fan housing 10.

Said ice filter 15, located within said diagnostic bypass filter fan housing 10, is the connection point for said non-mechanical air flow indicators "R". Said non-mechanical air flow indicators "R" comprising flexible, light weight ribbon type material attached at their bottoms to said ice filter 15, on the exit air flow side of said ice filter 15, with their upper portion being lifted upwardly by air flow produced below by said inline centrifugal fan 18.

Said front observation window 13, is located on the front side of said diagnostic bypass filter fan housing 10, is a molded plastic lens.

A mechanical air flow indicator "M" systematically monitors air flow velocity, air flow volume, air pressure, and ambient temperature within said diagnostic bypass filter fan housing 10, is attached to the exterior wall of said diagnostic bypass filter fan housing 10, with probes into said elliptical bulge area "B" above said inline centrifugal fan 18. Said mechanical air flow indicator "M" is an air flow meter with Pitot tube to monitor, display and record differential pressures, ambient temperatures, air flow volume, and air flow velocity, of said inline centrifugal fan 18, which is located within said diagnostic bypass filter fan housing 10.

Figure 7:
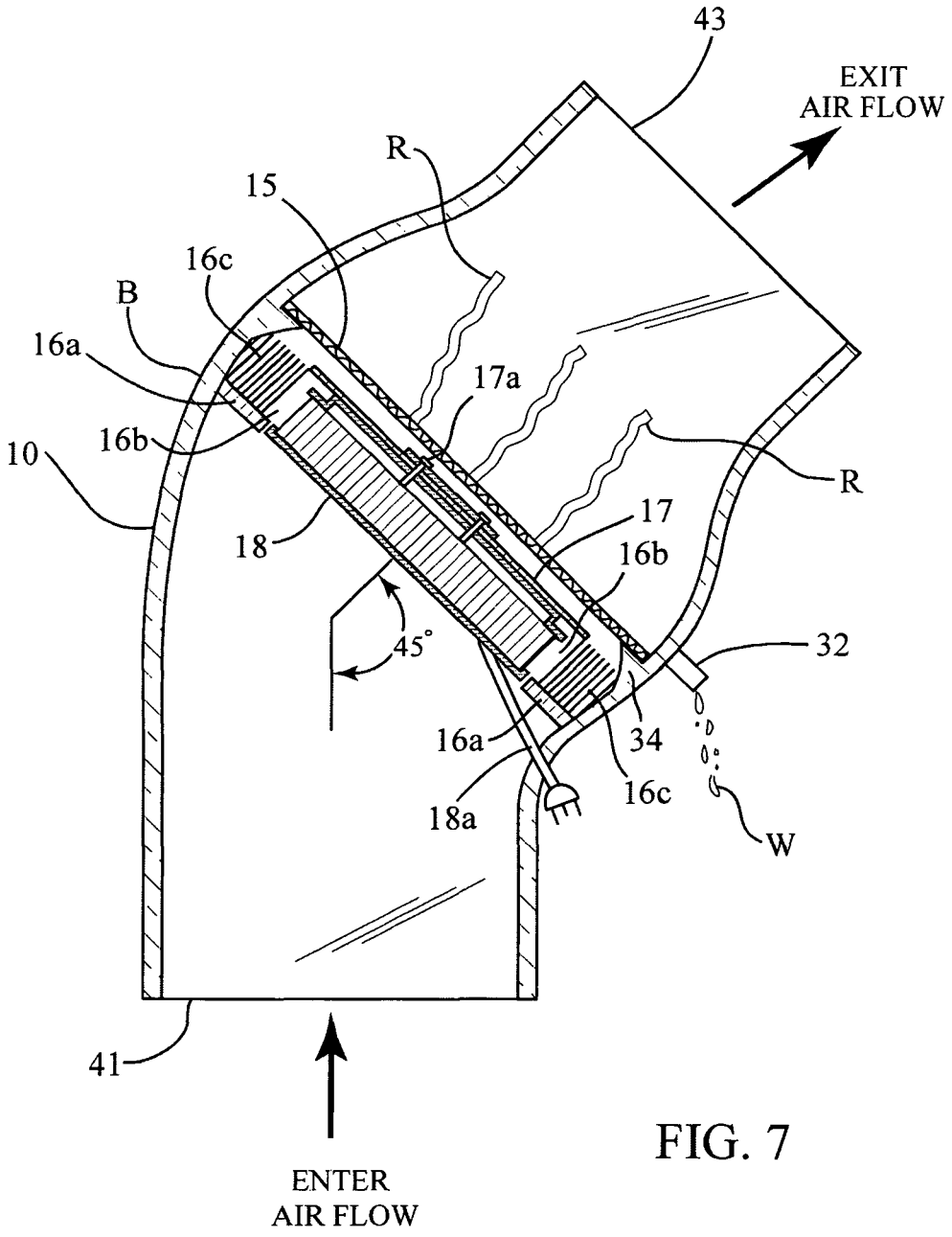
FIG. 7 shows a side cut-away view of diagnostic bypass filter fan housing.

FIG. 7 shows a side cross sectional view of said diagnostic bypass filter fan housing 10. Said inline centrifugal fan 18, is supported by and connected to said fan bracket 17, by said connection bolts 17*a*. Said fan bracket 17, is located above said inline centrifugal fan 18, and is molded to the inner upper corners of said plurality of spaced airflow redirecting vanes 16*c*. The outer edges of said plurality of spaced air flow redirecting vanes 16*c*, are molded to the interior wall surface of said diagnostic bypass filter fan housing 10.

Said uniform clearance gap 16*b*, is positioned between said plurality of spaced air flow redirecting vanes 16*c*, and said inline centrifugal fan 18, to provide a separation between said plurality of spaced air flow redirecting vanes 16*c*, and said inline centrifugal fan 18.

Said elliptical bulge area "B", is an expanded area within said diagnostic bypass filter fan housing 10, to provide additional space for the placement of said plurality of spaced airflow redirecting vanes 16*c*, said solid base 16*a*, said plurality of spaced air flow redirecting vanes 16*c*, said inline centrifugal fan 18, said fan bracket 17, said connection bolts 17*a*, and said ice filter 15. Additionally, said elliptical bulge area "B" is an expanded area within said diagnostic bypass filter fan housing 10, to allow additional air volume to pass through said diagnostic bypass filter fan housing 10. Said fan power cord 18*a*, is first connected into and an extension of said inline centrifugal fan 18, which is located within said elliptical bulge area "B", which is located within said diagnostic bypass filter fan housing 10, said fan power cord 18*a*, extends through said diagnostic bypass filter fan housing 10.

Said ice filter 15, which is located within said elliptical bulge area "B", of said diagnostic bypass filter fan housing 10, is supported by said water gutter 34. Said ice filters 15, is positioned above said fan bracket 17, and is a connection point for said non-mechanical air flow indicator "R". Said non-mechanical air flow indicator "R", is a flexible ribbon like material attached at its bottom to said ice filter 15, with its upper portion being lifted upward by air velocity and air volume pumped by said inline centrifugal fan 18.

Said solid base 16*a*, which is molded to the inner wall of said diagnostic bypass filter fan housing 10, extends inward and is molded to said plurality of spaced air flow redirecting vanes 16*c*.

Said solid base 16*a*, is connected at its top surface to the bottom edges of said plurality of spaced air flow redirecting vanes 16*c*.

Figure 8:
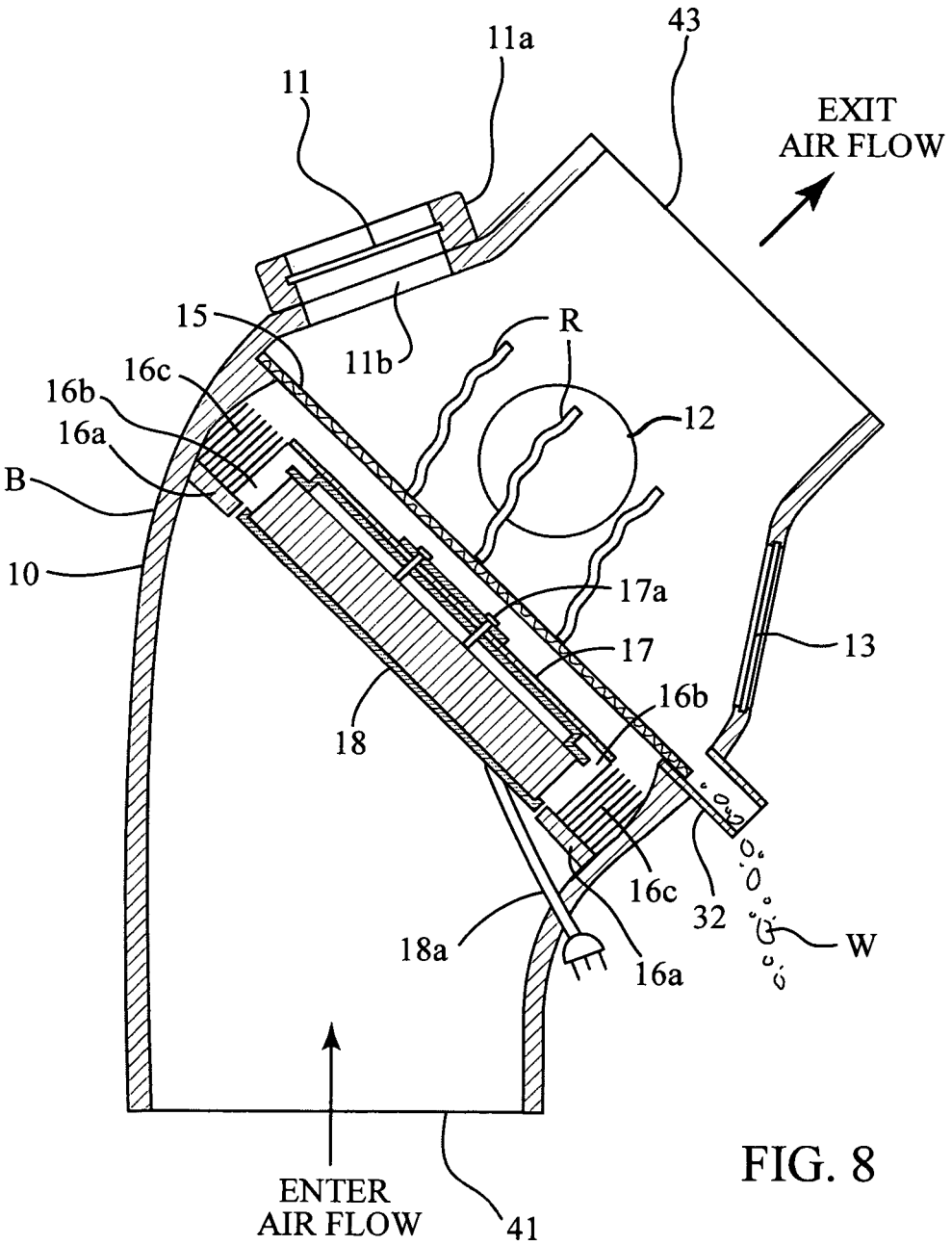
FIG. 8 shows a side cut-away view of diagnostic bypass filter fan housing.

FIG. 8 shows a side cross sectional view of said elliptical bulge area "B", within said diagnostic bypass filter fan housing 10. Located within said elliptical bulge area "B", of said diagnostic bypass filter fan housing 10, is said inline centrifugal fan 18, which is connected to said fan bracket 17, with said connection bolts 17*a*. Said fan bracket 17, is molded to inner upper corners of said plurality of spaced air flow redirecting vanes 16*c*. The outer edges of said plurality of spaced air flow redirecting vanes 16*c*, are molded to the inner wall of said connection bolts 17*a*, connects said inline centrifugal fan 18, to the underside of said fan bracket 17. Said inline centrifugal fan 18, is even and coaxial to said plurality of spaced air flow redirecting vanes 16*c*. Said plurality of spaced air flow redirecting vanes 16*c*, are separated from said inline centrifugal fan 18, by said uniform clearance gap 16*b*. Said solid base 16*a*, is molded to the bottom of said plurality of spaced air flow redirecting vanes 16*c*.

Said ice filter 15, which is located within said elliptical bulge area "B", of said diagnostic bypass filter fan housing 10, provides a connection base for said non-mechanical air flow indicator "R". Said access opening 11*b*, is located on the rear side of said diagnostic bypass filter fan housing 10. Said closure cap 11*a*, is a removable air-tight seal when inserted into said access opening 11*b*, during normal operational periods. Said rear observation window 11, is located within said access opening 11*b*, to allow observation without entering said diagnostic bypass filter fan housing 10

Said access opening 11*b*, serves as a secondary air vent port for system testing of said inline centrifugal fan 18.

Figure 9:
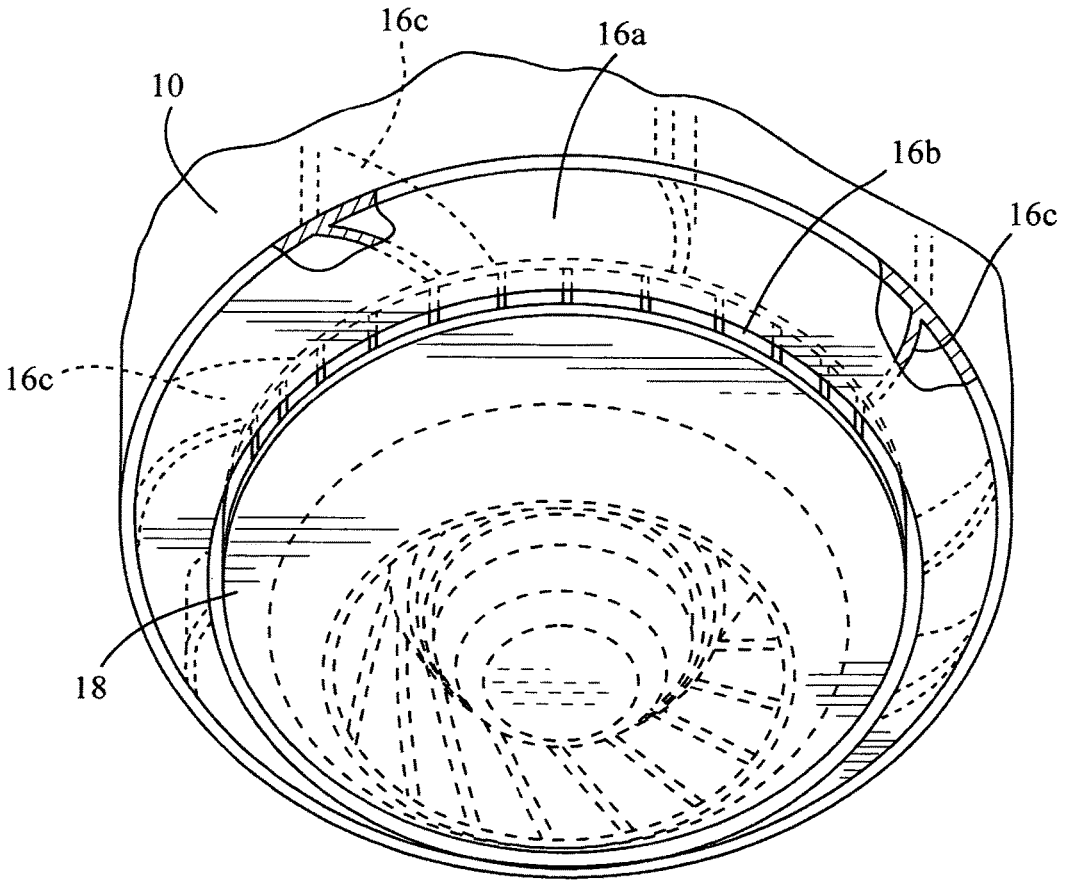
FIG. 9 shows a bottom view of a solid base, inline fan and directional vanes within the housing.

FIG. 9 shows, viewed from below, an enlarged sectional view of said plurality of spaced air flow redirecting vanes 16*c*, molded to the interior wall of said diagnostic bypass filter fan housing 10, said inline centrifugal fan 18, which is even and coaxial to said plurality of spaced air flow redirecting vanes 16*c*.

Said plurality of spaced air flow redirecting vanes 16*c*, are not connected to said inline centrifugal fan 18. Said inline centrifugal fan 18, is positioned coaxial to the plurality of spaced air flow redirecting vanes 16*c*, within the diagnostic bypass filter fan housing 10. Said plurality of spaced air flow redirecting vanes 16*c*, are molded at an outer proximal edge to the inner wall of said diagnostic bypass filter fan housing 10, and radially extend inward from said inner wall of said diagnostic bypass filter fan housing 10, toward, but not to a radially outermost perimeter of said inline centrifugal fan 18, resulting in a uniform clearance gap 16*b*, between said inline centrifugal fan 18, and said plurality of spaced air flow redirecting vanes 16*c*, said uniform clearance gap 16*b*, being sized in radial dimension. Said solid base 16*a*, with a circular center opening that permits the insertion of said inline centrifugal fan 18, which is even and coaxial to said plurality of spaced air flow redirecting vanes 16*c*.

Said inline centrifugal fan 18, is a mechanical device for pumping air or other gases through a conduit. It has a fan wheel composed of a number of fan blades mounted around a hub. Said inline centrifugal fan 18, is further described as a motorized direct drive device with a curved centrifugal-type motorized impeller, with a maintenance-free, thermally protected, UL approved motor with sealed ball-bearings. It is ETL listed for indoor or outdoor use. The inclined blades pumps air, to be discharged through said diagnostic bypass filter fan housing 10.

Figure 10:
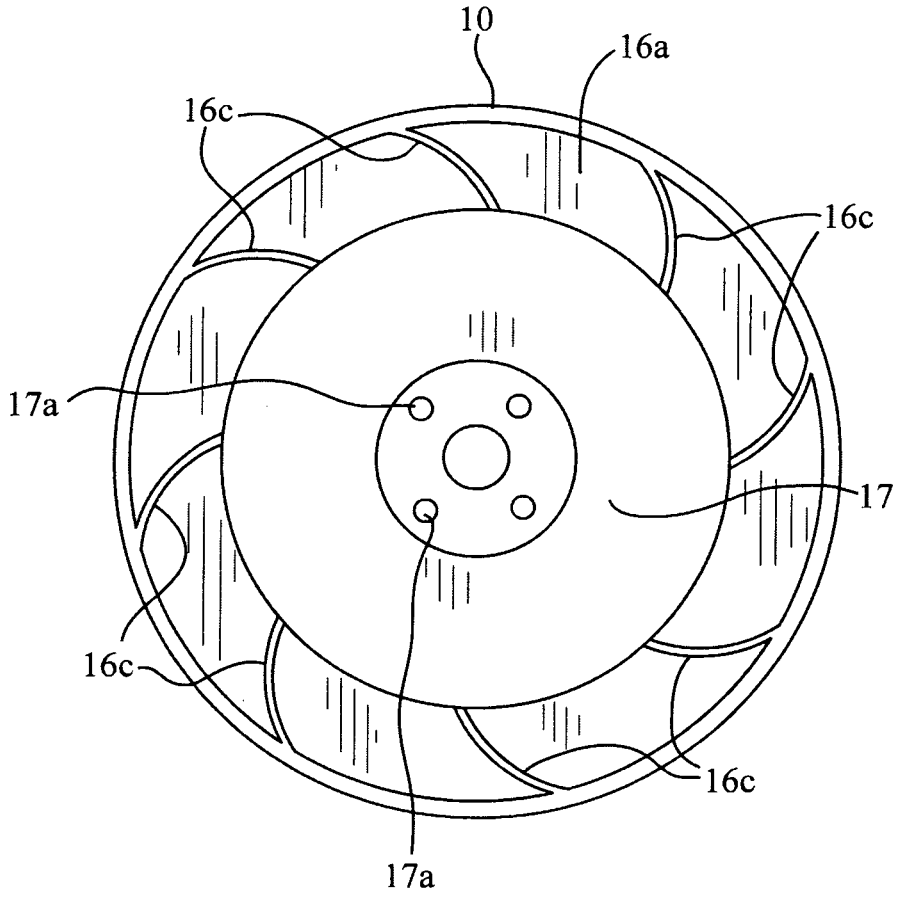
FIG. 10 shows a top view of directional vanes and fan bracket within the housing.

FIG. 10 shows, viewed from above, a cutaway view of said diagnostic bypass filter fan housing 10, with said plurality of spaced air flow directing vanes 16*c*, outer edges molded to the inner wall of said diagnostic bypass filter fan housing 10. The outside perimeter of said fan bracket 17, is molded to and supported by the inner upper corners of said plurality of spaced air flow redirecting vanes 16*c*. The outward edges of said plurality of spaced air flow redirecting vanes 16*c*, are molded to the inner wall of said diagnostic bypass filter fan housing 10.

Said diagnostic bypass filter fan housing 10, said solid base 16*a*, said plurality of spaced air flow redirecting vanes 16*c*, and said fan bracket 17, are together as one molded unit and manufactured as one molded unit.

Said inline centrifugal fan 18, is attached beneath said fan bracket 17, by said connection bolts 17*a*, Said fan bracket 17, is coaxial to said plurality of spaced air flow directing vanes 16*c*. Said fan bracket is molded to the inner upper corners of said plurality of spaced air flow redirecting vanes 16*c*.

Said solid base 16*a*, is positioned below and molded to the bottom edges of said plurality of spaced air flow redirecting vanes 116*c*. The outer edge of said solid base 16*a*, is molded to the inner wall of said diagnostic bypass filter fan housing 10.

Said plurality of spaced air flow redirecting vanes 16*c*, each having an inner distal edge and connected at an outer proximal edge thereof to, and radially extending inward from an inner wall of said diagnostic bypass filter fan housing 10, toward, but not to a radially outermost perimeter of said inline centrifugal fan 18.

Figure 11:
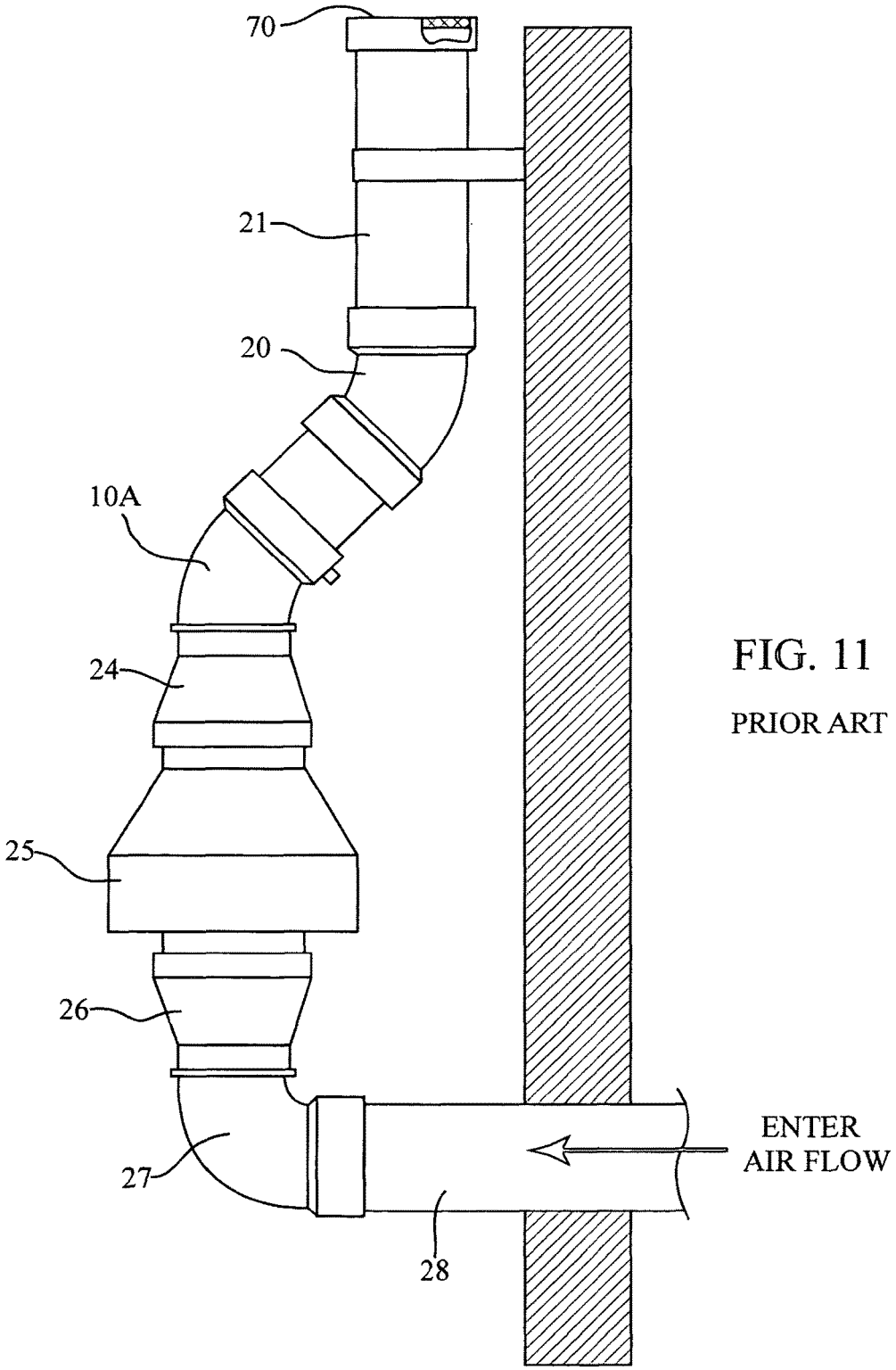
FIG. 11 PRIOR ART
FIG. 11 shows a side view of prior art of a typical unimproved gaseous fluid (radon) mitigation system.

FIG. 11 shows an unimproved prior art view of a radon mitigation system. Radon laced air is drawn into said suction side, pipe 28, continues through said suction side, elbow 27, continues through a hollow flexible suction coupling 26, and continues into an unimproved gaseous fluid (radon) exhaust fan 25. The radon laced air is pumped by the said unimproved gaseous fluid (radon) exhaust fan 25, into a flexible exhaust side, coupling 24, same air continues through the unimproved condensate bypass housing 10A, continues through said exhaust side, elbow 20, continues through said exhaust side, pipe 21, to exit through an unimproved metal bird and animal screen 70. During normal, above freezing conditions said unimproved metal bird and animal screen 70 reduces air flow due to displacement by grid wires within said unimproved metal bird and animal screen 70. Additionally, during below freezing conditions said unimproved metal bird and animal screen 70, is subject to freezing closed when atmosphere temperatures are below 32 F. Additionally, the air being exhausted through said unimproved metal bird and animal screen 70, contains a high degree of water vapor condensate which attaches to the frozen grid wires to develop blockage during freezing weather.

The unimproved condensate bypass 10A, does not provide an ice screen 15, enlarged bulge area "B", observation windows 11-12-13, access opening 11*b*, closure cap 11*a*, non-mechanical air flow indicator "R", mechanical air flow indicator "M", self contained inline fan 18, and redirecting vanes 16, vent housing 23.

OPERATIONS

FIG. 1 shows side view of a gaseous fluid (radon) mitigation system 200, with a hollow continuous air movement piping system originating from sub-soil "S" below a building concrete floor slab "F" to terminate above a roof edge of a building.

A diagnostic bypass filter fan housing 10, of said improved gaseous fluid (radon) mitigation system 200 draws warm, moist radon laced air from under said building concrete floor slab "F" and pumps same warm, moist radon laced air through said diagnostic bypass filter fan housing 10, to be expelled through a vent housing 23, into the atmosphere.

Embodiments shown within said diagnostic bypass filter fan housing 10, including a circular suction port 41, a circular exhaust port 43 and a fan power cord 18A.

Components shown below said diagnostic bypass filter fan housing 10, is suction side, pipe 28, and suction side, elbow 27, which comprises the suction side of said gaseous fluid (radon) mitigation system 200.

Components shown above said diagnostic bypass filter fan housing 10, is exhaust side elbow 20, exhaust side, pipe 21, said vent housing 23, and exhaust side, pipe 21, being attached to building wall by an exhaust side, pipe support bracket 22, which comprises the exhaust side of said gaseous fluid (radon) mitigation system 200.

Said vent housing 23 is a hollow cylindrical shaped embodiment which receives radon laced air from said exhaust side, pipe 21, and expels same radon laced air into the atmosphere.

Exhaust openings of said vent housing 23, allows maximum air flow discharge while preventing intrusion of rain water and destructive object. The multiple openings of said vent housing 23, are positioned on a vertical plane and are sized and shaped to allow maximum air flow to exit said vent housing 23.

The larger air flow capacity of the air exhaust openings exceeds the capacity of air entering said vent housing 23 thus reducing the negative impact of ice blockage caused by below freezing temperatures.

Said vent housing 23, contains 96 vertical openings, sized at 2.25 inches horizontally by 0.25 inches vertically, to provide 54 square inches of air flow exit capacity.

A typical 3.00 inch inside diameter exhaust pipe is 7.07 square inches, resulting air flow ratio of 7 outgoing to 1 incoming, or an increase of over 700% to provide additional air flow capacity when freezing temperatures cause ice formation resulting in blockage.

FIG. 2 shows rear view of said diagnostic bypass filter fan housing 10, with a rear observation window 11, within a closure cap 11*a*. Said closure cap 11*a*, is removable to allow inspections and to monitor the performance of an inline centrifugal fan 18, located within said diagnostic bypass filter fan housing 10, additionally, said closure cap 11*a*, may be removed during normal system operations to provide an air discharge port during testing exercises.

Said rear observation window 11, located within said closure cap 11*a*, is an observation window of molded plastic, to visually observe conditions within said diagnostic bypass filter fan housing 10, and to allow solar heat and solar light to enter said diagnostic bypass filter fan housing 10, to assist with inspections and melting ice.

Within said diagnostic bypass filter fan housing 10, is an elliptical bulge area "B" with a hidden view of a water drain spout 32, which carries water away from said diagnostic bypass filter fan housing 10, to prevent water damage to said inline centrifugal fan 18, located within said diagnostic bypass filter fan housing 10.

A plurality of spaced air flow redirecting vanes 16*c*, and said inline centrifugal fan 18, are positioned directly beneath an ice filter 15. Said ice filter 15, is located above said inline centrifugal fan 18, and is located within said elliptical bulge area "B", which is located within said diagnostic bypass filter fan housing 10.

FIG. 3 shows the side view of said diagnostic bypass filter fan housing 10, with said rear observation window 11, left and a right side observation windows 12, and front observation window 13. Said water drain spout 32, through which water "W", flows out of the interior of said diagnostic bypass filter fan housing 10, is within said elliptical bulge area "B".

Within said diagnostic bypass filter fan housing 10, is said elliptical bulge area "B" with a hidden view of said ice filter 15, located above said plurality of spaced air flow redirecting vanes 16*c*. Said plurality of spaced air flow redirecting vanes 16*c*, provide protection of said inline centrifugal fan 18, from directly falling ice which forms on said ice filter 15.

Attached to said inline centrifugal fan 18, is said fan power cord 18*a*, which extends through said diagnostic bypass filter fan housing 10, to provide electrical current to said inline centrifugal fan 18.

Said rear observation window 11, and said and right side observation windows 12, and said front observation window 13, individually or combined provides an expanded visual view within said diagnostic bypass filter fan housing 10, to assist monitoring of the interior working conditions of said diagnostic bypass filter fan housing 10.

Additionally, said rear observation window 11, said left and right side observation windows 12, and said front observation window 13, individually or combined, provides solar light or mechanical light to enter said diagnostic bypass filter fan housing 10, to assist with visual observations within said diagnostic bypass filter fan housing 10.

Additionally, said rear observation window 11, said left and right observation windows 12, and said front observation window 13, individually or combined, provide solar heat to enter said diagnostic bypass filter fan housing 10, to assist with the melting of ice suspended by said ice filter 15. Said ice filter 15, located within said elliptical bulge area "B", blocks and suspends ice falling from above within said diagnostic bypass filter fan housing 10, to prevent ice from damaging said inline centrifugal fan 18.

Said inline centrifugal fan 18, located below said ice filter 15, is centrally positioned within said elliptical bulge area "B", and coaxial to said plurality of spaced air flow redirecting vanes 16*c*, pumps warm moist radon laced air laterally into said plurality of spaced air flow redirecting vanes 16*c*. Said plurality of spaced air flow redirecting vanes 16*c*, located above said solid base 16*a*, redirects the same air upward through said ice filter 15, onto ice which is suspended by said ice filter 15, to assist in the melting process.

The outer edges of said plurality of spaced air flow directing vanes 16*c*, are molded to the inner wall of said diagnostic bypass filter fan housing 10.

The inner edges of said plurality of spaced air flow redirecting vanes 16*c*, radially extend inward toward the center of said elliptical bulge area "B", ending close to, but not touching said inline centrifugal fan 18.

Said plurality of spaced air flow redirecting vanes 16*c*, receives air, which is pumped laterally from said inline centrifugal fan 18, and redirects same air upward through said diagnostic bypass filter fan housing 10.

Said inline centrifugal fan 18, is coaxial to said plurality of spaced air flow redirecting vanes 16*c*, but not touching, resulting in a uniform-clearance gap 16*b*, separating said inline centrifugal fan 18, and said plurality of spaced air flow redirecting vanes 16*c*, additionally, said inline centrifugal fan 18, is positioned even and is coaxial to said plurality of spaced air flow redirecting vanes 16*c*.

A circular centered fan bracket 17, is molded into the inner upper corners of said plurality of spaced air flow redirecting vanes 16*c*. Said fan bracket 17, is orientated to hold said inline centrifugal fan 18. Said ice filter 15, blocks and suspends falling ice from above providing protection of said inline centrifugal fan 18, from ice damage.

Said fan bracket 17, provide additional protection of said inline centrifugal fan 18, from falling ice, which forms on said ice filter 15, by providing a barrier between said inline centrifugal fan 18, and said ice filter 15.

Said plurality of spaced air flow redirecting vanes 16*c*, provide additional protection of said inline centrifugal fan 18, from directly falling ice, which forms on said ice filter 15.

Said inline centrifugal fan 18, is positioned below and connected to said fan bracket 17 and is even and coaxial with said plurality of spaced air flow redirecting vanes 16*c*.

Said inline centrifugal fan 18, is a mechanical device for pumping air or other gases through a conduit.

Within said diagnostic bypass filter fan housing 10, said inline centrifugal fan 18, pumps air laterally, into said plurality of spaced air flow redirecting vanes 16*c*, and same air is redirected upward through said plurality of spaced air flow redirecting vanes 16*c*, through said diagnostic bypass filter fan housing 10. Said fan power cord 18*a*, is connected to and is an extension of said inline centrifugal fan 18, and connects to an outside electrical service to provide electrical current to activate said inline centrifugal fan 18.

FIG. 4 shows front view of said diagnostic bypass filter fan housing 10, with said rear observation window 11, said left and right side observation windows 12, said front observation window 13, and said water drain spout 32, molded to said diagnostic bypass filter fan housing 10. Said water drain spout 32, carries said water "W" to the exterior of said diagnostic bypass filter fan housing 10.

Within said elliptical bulge area "B", is said plurality of spaced air flow redirecting vanes 16*c*, and a uniform clearance gap 16*b*, separating said inline centrifugal fan 18.

Said uniform clearance gap 16*b*, separates the outer perimeter of said inline centrifugal fan 18, and the inner edges of said plurality of spaced air flow redirecting vanes 16*c*, to provide said uniform clearance gap 16*b*, between outer perimeter of said inline centrifugal fan 18, and inner edges of said plurality of spaced air flow redirecting vanes 16*c*.

The outer perimeter of said fan bracket 17 is molded to the inner upper corners of said plurality of spaced air flow redirecting vanes 16*c*. The outer edges of said plurality of spaced air flow redirecting vanes 16*c*, are molded to the inner wall of said diagnostic bypass filter fan housing 10.

The outermost perimeter of said solid base 16*a*, is molded to the inner wall of said diagnostic bypass filter fan housing 10, and molded to the bottom edges of said plurality of spaced air flow redirecting vanes 16*c*.

Said inline centrifugal fan 18, is centrally positioned within said elliptical bulge area "B", to mechanically pump radon laced earth temperature air containing high moisture content into said plurality of spaced air flow redirecting vanes 16*c*, which redirects same warm moist air upward into ice which is suspended by said ice filter 15. The outer edges of said plurality of spaced air flow directing vanes 16*c*, are molded to the inner wall of said diagnostic bypass filter fan housing 10, and are molded to said solid base 16*a*.

The inner edges of said plurality of spaced air flow redirecting vanes 16*c*, are radially extended inward toward the center of said elliptical bulge area "B", ending close to, but not touching said inline centrifugal fan 18, resulting in said uniform clearance gap 16*b*.

The inner upper corners of said plurality of spaced air flow redirecting vanes 16*c*, are molded to the outer perimeter of said fan bracket 17.

Said inline centrifugal fan 18, is coaxial to said plurality of spaced air flow redirecting vanes 16*c*, but not touching, therefore resulting in said uniform clearance gap 16*b*, between said inline centrifugal fan 18, and said plurality of spaced air flow redirecting vanes 16*c*.

The upper side of said inline centrifugal fan 18, is connected to the bottom side of said fan bracket 17, with connection bolts 17*a*, therefore positioning said inline centrifugal fan 18, even and coaxial with said plurality of spaced air flow redirecting vanes 16*c*.

Said inline centrifugal fan 18, is a mechanical device for pumping air or other gases through a conduit. Said inline centrifugal fan 18, pumps air latterly into said plurality of spaced air flow redirecting vanes 16*c*, which redirects same air upward through said ice filter 15, and continues upward through said diagnostic bypass filter fan housing 10.

FIG. 5 shows a rear cross sectional view of said diagnostic bypass filter fan housing 10. The inner edges of said plurality of spaced air flow redirecting vanes 16*c*, and the outer edge of said inline centrifugal fan 18, are separated by said uniform clearance gap 16*b*.

The inner upper corners of said plurality of spaced air flow redirecting vanes 16*c*, are molded to the outer perimeter of said fan bracket 17.

The top side of said inline centrifugal fan 18, is connected to the bottom side of said fan bracket 17, by connection bolts 17*a*. Said ice filter 15, blocks and suspends falling ice from above providing protection of said inline centrifugal fan 18, from ice damage.

Said plurality of spaced air flow redirecting vanes 16*c*, provide additional protection of said inline centrifugal fan 18, from falling ice, which forms on said ice filter 15.

Said fan bracket 17, provide additional protection of said inline centrifugal fan 18, from falling ice, which forms on said ice filter 15, by providing a barrier between said inline centrifugal fan 18, and said ice filter 15.

The proximity of said inline centrifugal fan 18, to the ice suspended by said ice filter 15, facilitates the ice dissipation by the warm moist air, resulting in prevention or removal of ice blockage at said ice filter 15.

Said inline centrifugal fan 18 is coaxial and even to said plurality of spaced air flow redirecting vanes 16*c*. Said fan bracket 17, is molded at its outer perimeter to the inner upper corners of said plurality of spaced air flow redirecting vanes 16*c*. The outer edges of said plurality of spaced air flow redirecting vanes 16*c*, are molded to the inner wall of said diagnostic bypass filter fan housing 10.

Said plurality of spaced air flow redirecting vanes 16*c*, redirects air upward that is pumped laterally by said inline centrifugal fan 18, which is coaxial to said plurality of spaced air flow redirecting vanes 16.

Said inline centrifugal fan 18, is connected to said fan bracket 17, being secured by said connection bolts 17*a*. Said fan bracket 17, is positioned above said inline centrifugal fan 18.

Said fan bracket 17, is molded to the inner upper corners of said plurality of spaced air flow directing vanes 16*c*.

Said inline centrifugal fan 18, is separated from said plurality of spaced air flow redirecting vanes 16*c*, by said uniform clearance gap 16*b*.

Said ice filter 15, is positioned directly above said fan bracket 17, and said polarity of spaced air flow redirecting vanes 16*c*. Said inline centrifugal fan 18, is positioned below and connected to said fan bracket 17 by said connection bolts 17*a*.

Said fan power cord 18*a*, of said inline centrifugal fan 18, extends through said diagnostic bypass filter fan housing 10. A non-mechanical air flow indicator "R", which is a flexible ribbon like length of material, is connected to, and extends above said ice filter 15, and is upwardly activated by passing air velocity which is pumped by said inline centrifugal fan 18. Said non-mechanical air flow indicator "R" provides a visual observation tool by which conditions within said diagnostic bypass filter fan housing 10, can be monitored from outside said diagnostic bypass filter fan housing 10, through said observation windows 11, 12, 13.

Said front observation window 13, is positioned on the front side of and molded to said diagnostic bypass filter fan housing 10.

FIG. 6 shows a rear cross sectional view of said diagnostic bypass filter fan housing 10, with said plurality of spaced air flow redirecting vanes 16*c*, molded to the inner wall of said diagnostic bypass filter fan housing 10. Said fan bracket 17, is molded to inner upper corners of said plurality of spaced air flow redirecting vanes 16.

Said ice filter 15, blocks and suspends falling ice from above providing protection of said inline centrifugal fan 18, from ice damage. Said plurality of spaced air flow redirecting vanes 16*c*, provide additional protection of said inline centrifugal fan 18, from falling ice, which forms on said ice filter 15. Said fan bracket 17, provide additional protection of said inline centrifugal fan 18, from falling ice, which forms on said ice filter 15, by providing a barrier between said inline centrifugal fan 18, and said ice filter 15.

The proximity of said inline centrifugal fan 18, to the ice suspended by said ice filter 15, facilitates the ice dissipation by the warm moist air, resulting in prevention or removal of ice blockage at said ice filter 15.

Said polarity of spaced air flow redirecting vanes 16*c*, are molded into the upper surface of said solid base 16*a*, and the outer edge of said solid base 16*a*, is molded to the inner wall of said diagnostic bypass filter fan housing 10. Said inline centrifugal fan 18, is attached to the bottom side of said fan bracket 17, with connection bolts 17*a*. Said inline centrifugal fan 18, is coaxial to the plurality of spaced air flow redirecting vanes 16*c*.

Said uniform clearance gap 16*b*, separates the outer perimeter of said inline centrifugal fan 18, from the inner edges of said plurality of spaced air flow redirecting vanes 16*c*.

Said solid base 16*a*, said plurality of spaced air flow redirecting vanes 16*c*, said inline centrifugal fan 18, and said fan bracket 17, are located below said ice filter 15, within said elliptical bulge area "B". Said fan power cord 18*a*, is an extension of said inline centrifugal fan 18, which extends out through said diagnostic bypass filter fan housing 10.

Said ice filter 15, located within said diagnostic bypass filter fan housing 10, is the connection point for said non-mechanical air flow indicators "R". Said non-mechanical air flow indicators "R" comprising flexible, light weight ribbon type material attached at their bottoms to said ice filter 15, on the exit air flow side of said ice filter 15, with their upper portion being lifted upwardly by air flow produced below by said inline centrifugal fan 18.

Said front observation window 13, is located on the front side of said diagnostic bypass filter fan housing 10, for entrance free observation of the interior.

A mechanical air flow indicator "M" systematically monitors air flow velocity, air flow volume, air pressure, and ambient temperature within said diagnostic bypass filter fan housing 10, and is attached to the exterior wall of said diagnostic bypass filter fan housing 10, with probes extending into said elliptical bulge area "B" above said inline centrifugal fan 18. Said mechanical air flow indicator "M" is an air flow meter with Pitot tube to monitor and display and record differential pressures, ambient temperatures, air flow volume, and air flow velocity, of said inline centrifugal fan 18, which is located within said diagnostic bypass filter fan housing 10.

FIG. 7 shows a side cross sectional view of said diagnostic bypass filter fan housing 10.

Warm moist radon laced air is pumped by said inline centrifugal fan 18, up through a circular suction port 41, and laterally into said plurality of spaced air flow redirecting vanes 16*c*, same air is redirected by said plurality of spaced air flow redirecting vanes 16*c*, upward through a circular exhaust port 43, of said diagnostic bypass filter fan housing 10.

Said inline centrifugal fan 18, is supported by and connected to said fan bracket 17 by said connection bolts 17*a*. Said fan bracket 17, which is located above said inline centrifugal fan 18, is molded to the inner upper corners of said plurality of spaced airflow redirecting vanes 16*c*. The outer edges of said plurality of spaced air flow redirecting vanes 16*c*, are molded to the interior wall surface of said diagnostic bypass filter fan housing 10.

Said ice filter 15, blocks and suspends falling ice from above providing protection of said inline centrifugal fan 18, from ice damage.

Said plurality of spaced air flow redirecting vanes 16*c*, provide additional protection of said inline centrifugal fan 18, from falling ice, which forms on said ice filter 15.

Said fan bracket 17, provide additional protection of said inline centrifugal fan 18, from falling ice, which forms on said ice filter 15, by providing a barrier between said inline centrifugal fan 18, and said ice filter 15.

The proximity of said inline centrifugal fan 18, to the ice suspended by said ice filter 15, facilitates the ice dissipation by the warm moist air, resulting in prevention or removal of ice blockage at said ice filter 15.

Said uniform clearance gap 16*b*, is positioned between said plurality of spaced air flow redirecting vanes 16*c*, and said inline centrifugal fan 18, to provide a separation between said plurality of spaced air flow redirecting vanes 16*c*, and said inline centrifugal fan 18.

Said elliptical bulge area "B", is an expanded area within said diagnostic bypass filter fan housing 10, to provide additional space for the placement of said plurality of spaced airflow redirecting vanes 16*c*, said solid base 16*a*, said plurality of spaced air flow redirecting vanes 16*c*, said inline centrifugal fan 18, said fan bracket 17, said connection bolts 17*a*, and said ice filter 15. Additionally, said elliptical bulge area "B" is an expanded area within said diagnostic bypass filter fan housing 10, to allow additional air volume to pass through said diagnostic bypass filter fan housing 10, and to compensate for air reduction resulting from the placement of said plurality of spaced air flow redirecting vanes 16, said fan bracket 17, said inline centrifugal fan 18, said solid base 16*a*, and said ice filter 15, which individually or combined create air resistance within said diagnostic bypass filter fan housing 10.

Said fan power cord 18*a*, is first connected into and an extension of said inline centrifugal fan 18, which is located within said elliptical bulge area "B", which is located within said diagnostic bypass filter fan housing 10, said fan power cord 18*a*, extends through said diagnostic bypass filter fan housing 10.

Said ice filter 15, which is located within said elliptical bulge area "B", of said diagnostic bypass filter fan housing 10, is supported by said water gutter 34. Water gutter 34, catches said water "W", and directs said water "W", into said water drain spout 32, said water drain spout 32, carries said water "W", out of said diagnostic bypass filter fan housing 10, to bypass and protect said inline centrifugal fan 18, from water damage.

Said ice filter 15, is positioned above said fan bracket 17, and is a connection point for said non-mechanical air flow indicator "R". Said non-mechanical air flow indicator "R", is a flexible ribbon like material attached at their bottoms to said ice filter 15, and the upper portion being lifted upward by air velocity and air volume pumped by said inline centrifugal fan 18.

Said solid base 16*a*, which is molded to the inner wall of said diagnostic bypass filter fan housing 10, extends inward and is molded to said plurality of spaced air flow redirecting vanes 16*c*.

Said solid base 16*a*, is connected at its top surface to the bottom edges of said plurality of spaced air flow redirecting vanes 16*c*, to prevent downward air flow and induce upward air flow as it is pumped by said inline centrifugal fan 18, into said plurality of spaced air flow redirecting vanes 16*c*, to be directed upward.

FIG. 8 shows a side cross sectional view of said elliptical bulge area "B", within said diagnostic bypass filter fan housing 10.

Said elliptical bulge area "B", is an expanded area within said diagnostic bypass filter fan housing 10, to provide additional space for the placement of said plurality of spaced airflow redirecting vanes 16*c*, said solid base 16*a*, said plurality of spaced air flow redirecting vanes 16*c*, said inline centrifugal fan 18, said fan bracket 17, said connection bolts 17*a*, and said ice filter 15. Additionally, said elliptical bulge area "B", is an expanded area within said diagnostic bypass filter fan housing 10, to allow additional air volume to pass through said diagnostic bypass filter fan housing 10, and to compensate for air reduction resulting from the placement of said plurality of spaced air flow redirecting vanes 16, said fan bracket 17, said inline centrifugal fan 18, said solid base 16*a*, and said ice filter 15, which individually or combined create air resistance within said diagnostic bypass filter fan housing 10.

Said fan bracket 17, is molded to inner upper corners of said plurality of spaced air flow redirecting vanes 16*c*. The outer edges of said plurality of spaced air flow redirecting vanes 16*c*, are molded to the inner wall of Said connection bolts 17*a*, connects said inline centrifugal fan 18, to the underside of said fan bracket 17.

Said inline centrifugal fan 18, is even and coaxial to said plurality of spaced air flow redirecting vanes 16*c*, combine to pump and direct warm moist radon laced air upward from said circular suction port 41, and expel same air up through said circular exhaust port 43.

Said plurality of spaced air flow redirecting vanes 16*c*, are separated from said inline centrifugal fan 18, by said uniform clearance gap 16*b*. Said uniform clearance gap 16*b*, provides that air pumped by said inline centrifugal fan 18, enters said plurality of spaced air flow redirecting vanes 17*c*, in an efficient manner.

Said fan power cord 18*a*, supplies electrical current to said inline centrifugal fan 18, which mechanically pumps warm moist radon laced air from said circular suction port 41, through said diagnostic bypass filter fan housing 10, and pumps same air to exit through said circular exhaust port 43.

Said solid base 16*a*, is molded to the bottom of said plurality of spaced air flow redirecting vanes 16*c* to prevent downward air flow and direct upward air flow.

Outer perimeter of said solid base 16*a*, is molded to the inner wall of said diagnostic bypass filter fan housing 10 and radially extends inwardly toward, but not to, a radially outermost perimeter of said inline centrifugal fan 18, to define a uniform clearance gap 16*b*.

Said solid base 16*c*, blocks air within said plurality of spaced air flow redirecting vanes 16*c*, from improperly flowing downward and forcing same air to properly flow upward.

Said plurality of spaced air flow redirecting vanes 16*c*, provide additional protection of said inline centrifugal fan 18, from falling ice which forms on said ice filter 15.

Said fan bracket 17, provides additional protection of said inline centrifugal fan 18, from falling ice, which forms on said ice filter 15, by providing a barrier between said inline centrifugal fan 18, and said ice filter 15.

Said ice filter 15, which is located within said elliptical bulge area "B", of said diagnostic bypass filter fan housing 10, blocks ice from entering said inline centrifugal fan 10, and is a connection base for said non-mechanical air flow indicator "R".

Said non-mechanical air flow indicator "R" provides visual monitoring of the operational condition of said inline centrifugal fan 18, without the need to enter said diagnostic bypass filter fan housing 10. Visual inspections are performed by observations through said front observation window 13, said left and right observation windows 12, and rear observation window 11.

Said access opening 11*b*, is located on the rear side of said diagnostic bypass filter fan housing 10, to allow entry for maintenance and diagnostic inspections and off venting. Said access opening 11*b*, mates with said closure cap 11*a*, which is a removable air-tight seal when inserted into said access opening 11*b*. Said closure cap 11*a*, is a removable air-tight seal during normal operational periods, when inserted into said access opening 11*b*. Said access opening 11*b*, allows entry into said diagnostic bypass filter fan housing 10, for maintenance and system testing.

Said access opening 11*b*, additionally is an air relief port for off-venting during operation periods when ice or debris blocks air flow above said diagnostic bypass filter fan housing 10. Said observation windows 11, 12, and 13, allow solar and mechanical light to enter said diagnostic bypass filter fan housing 10, to assist visual inspections. Additionally, said observation windows 11, 12, and 13, allow solar heat to enter said diagnostic bypass filter fan housing 10, to prevent build-up of ice and assist melting of ice which is retained by said ice filter 15. Said water "W", is removed from said diagnostic bypass filter fan housing 10, through said water drain spout 32, to protect said inline centrifugal fan 18, from water damage.

FIG. 9 shows, viewed from below, an enlarged sectional view of outer edge of said solid base 16*a*, molded to the inner wall of said diagnostic bypass filter fan housing 10, and extended inward to a circular center opening that permits the insertion of said inline centrifugal fan 18. Said solid base 16*a*, prevents air flow produced from said inline centrifugal fan 18, from directing downward.

Said solid base 16*a*, is molded to the bottom edges of said plurality of spaced air flow redirecting vanes 16*c*, to be an air tight barrier preventing undesirable downward air flow within said plurality of spaced air flow redirecting vanes 16*c*.

The outer edges of said plurality of spaced air flow redirecting vanes 16*c*, are molded to the inner wall of said diagnostic bypass filter fan housing 10, and bottom edges are molded to said solid base 16*a*, to prevent downward air flow.

Said plurality of spaced air flow redirecting vanes 16*c*, are molded into said solid base 16*a*, each having an inner distal edge and an outer proximal edge molded into the inner wall of said diagnostic bypass filter fan housing 10, thereof to, and radially extending inward from, an inner surface of said diagnostic bypass filter fan housing 10, toward, but not to a radially outermost perimeter of said inline centrifugal fan 18, to define said uniform clearance gap 16*b*, between said plurality of spaced air flow redirecting vanes 16*c*, and said inline centrifugal fan 18.

Said inline centrifugal fan 18, is even and coaxial to said plurality of spaced air flow redirecting vanes 16*c*, and pumps air laterally into said plurality of spaced air flow redirecting vanes 16*c*, and same air is redirected upward to exit said diagnostic bypass filter fan housing 10. Said inline centrifugal fan 18, is positioned coaxial to the plurality of spaced air flow redirecting vanes 16*c*, within the diagnostic bypass filter fan housing 10. Said plurality of spaced air flow redirecting vanes 16*c*, are molded at an outer proximal edge to the inner wall of said diagnostic bypass filter fan housing 10, and radially extend inward from said inner wall of said diagnostic bypass filter fan housing 10, toward, but not to a radially outermost perimeter of said inline centrifugal fan 18, resulting in a uniform clearance gap 16*b*, between said inline centrifugal fan 18, and said plurality of spaced air flow redirecting vanes 16*c*, said uniform clearance gap 16*b*, being sized in radial dimension.

Said solid base 16*a*, is molded to the bottom edges of said plurality of spaced air flow redirecting vanes 16*c*, to form an air tight seal below said plurality of spaced air flow redirecting vanes 16*c*, to prevent air entering said plurality of spaced air flow redirecting vanes 16*c*, from improperly flowing downward. Said solid base 16*a*, with a circular center opening that permits the insertion of said inline centrifugal fan 18, which is positioned to be coaxial to said polarity of spaced air flow redirecting vanes 16*c*. The outer perimeter edge of said solid base 16*a*, is molded to the inner wall of said diagnostic bypass filter fan housing 10, and the top surface is molded to said plurality of spaced air flow redirecting vanes 16*c*.

As air is pumped laterally into said plurality of spaced air flow redirecting vanes 16*c*, from said inline centrifugal fan 18, it is redirected upward through said diagnostic bypass filter fan housing 10.

Said inline centrifugal fan 18, is a mechanical device for pumping air or other gases through a conduit. It has a fan wheel composed of a number of fan blades mounted around a hub. Said inline centrifugal fan 18, is further described as a motorized direct drive device with a backward curved centrifugal-type motorized impeller, with a maintenance-free, thermally protected, UL approved motor with sealed ball-bearings. It is ETL listed for indoor or outdoor use. The inclined blades pump air through said diagnostic bypass filter fan housing 10, and discharges it into said plurality of spaced air flow redirecting vanes 16*c*, located within said diagnostic bypass filter fan housing 10.

FIG. 10 shows, viewed from above, a cutaway view of said diagnostic bypass filter fan housing 10, with the outer edges of said plurality of spaced air flow directing vanes 16*c*, molded to the inner wall of said diagnostic bypass filter fan housing 10. The outside perimeter of said fan bracket 17, is molded to the inner upper corners of said plurality of spaced air flow redirecting vanes 16. The outward edges of said plurality of spaced air flow redirecting vanes 16*c*, are molded to the inner wall of said diagnostic bypass filter fan housing 10.

Said diagnostic bypass filter fan housing 10, said solid base 16*a*, said plurality of spaced air flow redirecting vanes 16*c*, and said fan bracket 17 are molded together as one molded unit and manufactured as one molded unit.

Said inline centrifugal fan 18 is attached to said fan bracket 17, by said connection bolts 17*a*, Said fan bracket 17, is coaxial to said plurality of spaced air flow directing vanes 16*c*, and is molded to the inner upper corners of said plurality of spaced air flow redirecting vanes 16*c*. Said inline centrifugal fan 18, is connected below said fan bracket 17, by said connection bolts 17*a*.

Said solid base 16*a*, is positioned below and molded to the bottom edges of said plurality of spaced air flow redirecting vanes 16*c* to prevent downward air flow.

The outer edge of said solid base 16*a*, is molded to the inner wall of said diagnostic bypass filter fan housing 10. Said plurality of spaced air flow redirecting vanes 16*c*, each having an inner distal edge and connected at an outer proximal edge thereof to, and radially extending inward from an inner surface of said diagnostic bypass filter fan housing 10, toward, but not to a radially outermost perimeter of said inline centrifugal fan 18.

CONCLUSION, RAMIFICATIONS AND SCOPE

Thus the reader will see that at least one embodiment of the apparatus provides a greater level of damage protection, monitoring and efficiency for a radon fan and radon mitigation system. Although the description above contains much specificity, these should not be construed as limiting the scope of the embodiments but as merely providing illustrations of some of the presently preferred embodiments. For example, the bulge can have other sizes and shapes such as circular, oval or eccentric. Another example is that the stated 45 degree angle can be other degrees of angle for the diagnostic bypass filter fan housing. Another example is the location and angle placement of the inline fan and redirecting vanes in relationship to the bulge area of the housing.

Thus the scope of the embodiments should be determined by the appended claims and their legal equivalents, rather than by the examples

The invention claimed is:

1. A diagnostic bypass filter fan apparatus within a diagnostic bypass filter fan housing in a gaseous fluid exhaust system for blocking falling ice which forms inside said exhaust system, debris, birds and animals which enter from the discharge end of said exhaust system, for diverting condensate which forms inside said exhaust system, for permitting visual inspections and internal cleaning of said diagnostic bypass filter fan apparatus, for permitting access to the inside of said diagnostic bypass filter fan apparatus for air quality and air flow testing, said exhaust system comprising an exhaust side having a hollow interior and an inner surface, a flexible exhaust coupling, a diagnostic bypass filter fan apparatus, a hollow exhaust pipe elbow, a hollow exhaust pipe on which ice and condensate may be formed, a discharge end with a vent housing where debris, birds and animals may enter, a suction side having a hollow interior, and an air flow producing fan apparatus located within said diagnostic bypass filter fan housing wherein said gaseous fluid is drawn by said air flow producing fan apparatus located within said diagnostic bypass filter fan housing from said suction side and expelled by said fan apparatus through said diagnostic bypass filter fan housing, through exhaust side of said exhaust system, said diagnostic bypass filter apparatus comprising:

a diagnostic bypass filter fan housing comprising a first open end and a second open end with a continuous hollow interior between said first open end and said second open end communicating between said first open end and said second open end having an elongated curved elbow configuration providing an angle between the said first open end and the said second open end of the circular section having an expanded circumference at the mid-section of the diagnostic bypass filter fan housing, elliptical bulge area forming an eccentric ellipse shaped expansion of said diagnostic bypass filter fan housing, said first open end communicating with said suction side of said exhaust system to said hollow interior thereof and said second open end communicating through said exhaust side of said exhaust system to said hollow interior thereof in a manner maximizing air flow; and a solid base molded to the inside of said fan housing with a circular center opening that permits the insertion of said inline centrifugal fan, and radially extending inwardly from, an inner surface of said housing toward, circumambient to, but not to, a radially outermost perimeter of said centrifugal fan to define a uniform clearance gap between said perimeter and said circular center opening, said gap being sized in radial dimension to be no greater than a minimal amount sufficient to avoid contact between said distal edges and said perimeter; and a plurality of evenly spaced air flow redirecting vanes that are molded into said base, each having an inner distal edge and an outer proximal edge molded into the inner surface of said fan housing thereof to, and radially extending inwardly from, an inner surface of said housing toward, circumambient to, but not to, a radially outermost perimeter of said centrifugal fan to define a uniform clearance gap between said perimeter and said distal edges, said gap being sized in radial dimension to be no greater than a minimal amount sufficient to avoid contact between said distal edges and said perimeter and, each said vane sized in the longitudinal direction of said fan housing to be equal to but not less than the discharge ports of said inline centrifugal fan; and a distal portion of each said vane having an arcuately concaved shape when viewed from said outlet along a longitudinal axis of said fan housing; a distal edge of each said vane positively orientated facing toward said outlet in-line with respect to a longitudinal axis of said fan housing discharge; and each said vane distal portion is orientated facing into air flow emanating radially outwardly from, and substantially tangent to, said periphery; and a circular center fan bracket that is molded into the inner upper corners of said air flow redirecting vanes, said circular centered fan bracket is orientated to hold said inline centrifugal fan such that the discharge from said inline centrifugal fan is captured by said air flow redirecting vanes; and a motorized inline centrifugal fan attached to said fan bracket within said housing; and a filter, with an axis of said filter substantially coincident with an axis of said first open end of said diagnostic bypass filter fan housing and said enlarged center elliptical bulge of said diagnostic bypass filter fan housing, comprising a diameter being dimensioned to fit said hollow interior circumference of the center of the said enlarged elliptical bulge and angular bend section of said diagnostic bypass filter fan housing, being arranged in a manner forming a barrier comprising said inner surface of said diagnostic bypass filter fan housing and an outer edge of said filter positioned to block falling ice, debris, birds and animals which may form and/or enter said exhaust system; and an air flow producing fan apparatus including structural support located within said diagnostic bypass filter fan housing between said filter and said first open end of said diagnostic bypass filter fan housing; and a gutter supporting said filter comprising a crescent shape gutter floor constructed as part of said hollow interior of said diagnostic bypass filter fan housing extending half way around said hollow interior of said diagnostic bypass filter and located at the lower apex of said elliptical bulge, said gutter substantially coincident with the axis of said first open end of said diagnostic bypass filter fan housing and positioned to collect condensate and melted ice which may drain within said diagnostic bypass filter fan housing; and air flow indicators comprising flexible, light-weight ribbon type material attached at their bottoms to said filter on the exit air flow side of the filter with their upper portion being lifted upwardly by air flow produced below by said air flow producing fan apparatus providing visual system performance evaluation without entering said diagnostic bypass filter fan housing; and a mechanical air flow indicator; and a drain spout comprising a hollow interior having a first open end and a second open end, said hollow interior communicating between said first open end and said second open end, said first open end of said drain spout communicating through said diagnostic bypass filter fan housing to said hollow interior there of immediately adjacent to the lowest point of a conical surface of said gutter and within said gutter, said second open end communicating with the outside of the said diagnostic bypass filter fan housing; and a removable observation window located in said diagnostic bypass filter fan housing between said filter and said second open end of said diagnostic bypass filter fan housing at an upper apex of said elliptical bulge comprising an access opening having a hollow female threaded interior having a first open and a second open end, said hollow female threaded interior communicating between said first open end and second open end , said first open end communicating with the outside of said diagnostic bypass filter fan housing and said second open end communicating with the interior of said elliptical bulge, and having a see through closure cap with male threads to match said access opening hollow female threaded interior having a bolt head configuration built in suitable for wrenching said closure cap on and off providing for the inspection and servicing of the interior of the diagnostic bypass filter fan housing, and sealing said access opening; and three observation windows located in said diagnostic bypass filter fan housing between said filter and said second open end of said diagnostic bypass filter fan housing, having two of said observation windows diametric to each other on the sides of said diagnostic bypass housing and the third said observation window diametric to said removable observation window providing the capability for visual inspection of said interior of the diagnostic bypass filter fan housing while said exhaust system is operating.

2. The diagnostic bypass filter fan apparatus of claim 1, wherein said exhaust system is a radon mitigation system.

3. The diagnostic bypass filter fan apparatus of claim 1, wherein said angle between the said first open end and the said second open end is forty-five degrees to ninety degrees.

4. The diagnostic bypass filter fan apparatus of claim 1, wherein said air flow producing fan apparatus is powered by an electrical motor with coincident air directional channels to increase air movement efficiency through said diagnostic bypass filter fan apparatus.

5. An exhaust system for removing a gaseous fluid containing radon comprising:

a diagnostic bypass filter fan apparatus comprising a housing having a first suction port and a second exhaust port and enclosing an air flow producing fan apparatus , wherein the operation of said air flow producing fan apparatus draws a gaseous fluid from said first suction port and expels said gaseous fluid from said second exhaust port;

a cylindrical suction conduit comprising a hollow interior, a first open end, and at least one other open end, said hollow interior communicating between first open end each of said at least one other open ends, said suction pipe being otherwise substantially air tight, wherein said first open end is substantially air tightly coupled with said suction port and each of said at least one other open ends is located proximate to said gaseous fluid so that said gaseous fluid is conducted by operation of said air flow producing fan from each of said at least one other open ends of said suction conduit through said suction conduit to said suction port;

a cylindrical exhaust conduit comprising a hollow interior, a first open end, at least one other open end, and an inner surface, said hollow interior communicating between said first open end and each one of said at least one other open ends, said exhaust pipe being otherwise substantially airtight, wherein said first open end is substantially air tightly coupled to said exhaust port each of said at least one other open ends is located at a predetermined level above ground so that said gaseous fluid is conducted by operation of said air flow producing fan from said exhaust port through said exhaust conduit to each of said at least one other open ends of said exhaust conduit;

a diagnostic bypass filter fan housing comprising a first open end and a second open end with a continuous hollow interior between said first open end and said second open end communicating between said first open end and said second open end having an elongated curved elbow configuration providing an angle between the said first open end and the said second open end of the circular section having an expanded circumference at the mid-section of the diagnostic bypass filter fan housing elliptical bulge area forming an eccentric ellipse shaped expansion of said diagnostic bypass filter fan housing, said first open end communicating with said suction side of said air flow producing fan apparatus to said hollow interior thereof and said second open end communicating through said exhaust side to said hollow interior thereof in a manner maximizing air flow; and a solid base molded to the inside of said fan housing with a circular center opening that permits the insertion of said inline centrifugal fan, and radially extending inwardly from, an inner surface of said housing toward, circumambient to, but not to, a radially outer most perimeter of said centrifugal fan to define a uniform clearance gap between said perimeter and said circular center opening, said gap being sized in radial dimension to be no greater than a minimal amount sufficient to avoid contact between said distal edges and said perimeter; and a plurality of evenly spaced air flow redirecting vanes that are molded into said base, each having an inner distal edge and an outer proximal edge molded into the inner surface of said fan housing thereof to, and radially extending inwardly from, an inner surface of said housing toward, circumambient to, but not to, a radially outermost perimeter of said centrifugal fan to define a uniform clearance gap between said perimeter and said distal edges, said gap being sized in radial dimension to be no greater than a minimal amount sufficient to avoid contact between said distal edges and said perimeter and, each said vane sized in the longitudinal direction of said fan housing to be equal to but not less than the discharge ports of said inline centrifugal fan; and a distal portion of each said vane having an arcuately concaved shape when viewed from said outlet along a longitudinal axis of said fan housing; a distal edge of each said vane positively orientated facing toward said outlet in-line with respect to a longitudinal axis of said fan housing discharge; and each said vane distal portion is orientated facing into air flow emanating radially outwardly from, and substantially tangent to, said periphery; and a circular center fan bracket that is molded into the inner upper corners of said air flow redirecting vanes, said circular centered fan bracket is orientated to hold said inline centrifugal fan such that the discharge from said inline centrifugal fan is captured by said air flow redirecting vanes; and a motorized inline centrifugal fan attached to said fan bracket within said fan housing; and a filter, with an axis of said filter substantially coincident with an axis of said first open end of said diagnosis bypass filter fan housing and said enlarged center elliptical bulge area of said diagnostic bypass filter housing, comprising a diameter being dimensioned to fit said hollow interior circumference of the center of the said enlarged elliptical bulge and angular bend section of said diagnostic bypass filter fan housing, being arranged in a manner forming a barrier comprising said inner surface of said diagnostic bypass filter fan housing and an outer edge of said filter positioned to block falling ice, debris, birds and animals which form and or enter said exhaust system; and an air flow producing fan apparatus located within said diagnostic bypass filter fan housing, located between said first open end and said filter; and a gutter supporting said filter comprising a crescent shape gutter floor constructed as part of said hollow interior of said diagnostic bypass filter fan housing extending half way around said hollow interior of said diagnostic bypass filter and located at a lower apex of said elliptical bulge, said gutter substantially coincident with the axis of said first open end of said diagnostic bypass filter fan housing and positioned to collect condensate and melted ice which form within said diagnostic bypass filter fan housing; and air flow indicators comprising flexible, light-weight ribbon type material attached at their bottoms to said filter on the exit air flow side of the filter with their upper portion being lifted upwardly by air flow produced below by said air flow producing fan apparatus providing visual system performance evaluation without entering said diagnostic bypass filter fan housing; and a mechanical air flow indicator; and a drain spout comprising a hollow interior having a first open end and a second open end, said hollow interior communicating between said first open end and said second open end, said first open end of said drain spout communicating through said diagnostic bypass filter fan housing to said hollow interior there of immediately adjacent to the lowest point of a conical surface of said gutter and within said gutter, said second open end communicating with the outside of the said diagnostic bypass filter fan housing to discharge said condensate and melted ice; and a removable observation window located in said diagnostic bypass filter fan housing between said filter and said second open end of said diagnostic bypass filter fan housing at an upper apex of said elliptical bulge comprising an access opening having a hollow female threaded interior having a first open and a second open end, said hollow female threaded interior communicating between said first open end and second open end , said first open end communicating with the outside of said diagnostic bypass filter housing and said second open end communicating with the interior of said elliptical bulge, and having a see through closure cap with male threads to match said access opening hollow female threaded interior having a bolt head configuration built in suitable for wrenching said closure cap on and off providing for the inspection and servicing of the interior of the diagnostic bypass filter and sealing said access opening; and three observation windows located in said diagnostic bypass filter housing between said filter and said second open end of said diagnostic bypass filter housing, having two of said observation windows diametric to each other on the sides of said diagnostic bypass housing and the third said observation window diametric to said removable observation window providing the capability for visual inspection of said interior of the diagnostic bypass filter housing while said radon mitigation system is operating; and a vent housing comprising a first open end and a second open end and a continuous hollow interior between said first open end and said second open end communicating between said first open end and said second open end having a hollow cylindrical shape with multiple horizontal elongated exhaust openings symmetrically running along and aligned at right angle to the latitudinal axis of said hollow cylindrical shape that are angled vertically with the interior side of said elongated exhaust openings being higher than the exterior of said elongated exhaust openings within the wall of said vent housing which prevent rain water and objects from entering said vent housing, said first open end of said vent housing is coupled to exit air flow end of said cylindrical exhaust conduit and second open end of said vent housing is sealed with a cap.

6. The vent housing of claim 5, wherein said horizontal elongated exhaust openings are sized at 2.25 inches horizontally by 0.25 inches vertically and are approximately 96 in number providing decreased air flow resistance which increases the efficiency of the exhaust system.

7. The vent housing of claim 5, wherein the said vent housing is manufactured with opaque or transparent materials providing for solar heat within said vent housing to prevent ice buildup and subsequent air-flow reduction.

8. The diagnostic bypass filter fan apparatus of claim 5, wherein said angle between the said first open end and the said second open end is forty-five degrees.

* * * * *